US009997129B2

(12) United States Patent
Nishimura et al.

(10) Patent No.: US 9,997,129 B2
(45) Date of Patent: Jun. 12, 2018

(54) CIRCUIT DEVICE, ELECTRO-OPTICAL DEVICE, AND ELECTRONIC APPARATUS

(71) Applicant: SEIKO EPSON CORPORATION, Tokyo (JP)

(72) Inventors: Motoaki Nishimura, Chino (JP); Akihiko Ito, Tatsuno-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days. days.

(21) Appl. No.: 15/267,952

(22) Filed: Sep. 16, 2016

(65) Prior Publication Data

US 2017/0092181 A1 Mar. 30, 2017

(30) Foreign Application Priority Data

Sep. 28, 2015 (JP) ..... 2015-189107

(51) Int. Cl.
*G09G 3/36* (2006.01)

(52) U.S. Cl.
CPC ..... *G09G 3/3696* (2013.01); *G09G 3/3607* (2013.01); *G09G 3/3688* (2013.01); *G09G 3/3614* (2013.01); *G09G 2320/0242* (2013.01); *G09G 2320/0276* (2013.01); *G09G 2320/0666* (2013.01); *G09G 2340/0435* (2013.01); *G09G 2370/08* (2013.01)

(58) Field of Classification Search
CPC .. G09G 3/3696; G09G 3/3607; G09G 3/3688; G09G 3/3614; G09G 2320/0233; G09G 2320/0242; G09G 2320/0276; G09G 2320/0666; G09G 2320/0673; G09G 2340/0435; G09G 2370/08
See application file for complete search history.

(56) References Cited

U.S. PATENT DOCUMENTS

| | | | | |
|---|---|---|---|---|
| 6,879,310 | B2 * | 4/2005 | Nose | G09G 3/3607 345/88 |
| 7,030,846 | B2 * | 4/2006 | Lee | G09G 3/3607 345/690 |
| 7,071,669 | B2 | 7/2006 | Morita | |
| 2002/0015043 | A1 * | 2/2002 | Matsuda | G09G 5/00 345/596 |

(Continued)

FOREIGN PATENT DOCUMENTS

| | | | |
|---|---|---|---|
| JP | 2003-233354 | A | 8/2003 |
| JP | 2004-029795 | A | 1/2004 |
| JP | 2006-039205 | A | 2/2006 |

*Primary Examiner* — Tom Sheng
(74) *Attorney, Agent, or Firm* — Oliff PLC

(57) ABSTRACT

A circuit device includes a grayscale voltage generation circuit that generates a plurality of grayscale voltages, a data processing unit that performs data processing of first color component display data to third color component display data, and a drive unit that drives a display panel based on the first color component display data to the third color component display data that are subjected to the data processing and the plurality of grayscale voltages that are used in common for the first color component display data to the third color component display data. The data processing unit performs grayscale correction processing on at least one color component display data of the first color component display data to the third color component display data in a grayscale correction range.

17 Claims, 15 Drawing Sheets

(56) References Cited

U.S. PATENT DOCUMENTS

| | | | | |
|---|---|---|---|---|
| 2003/0020725 | A1* | 1/2003 | Matsuda | G09G 5/00 345/600 |
| 2003/0231153 | A1 | 12/2003 | Seong et al. | |
| 2005/0007393 | A1* | 1/2005 | Akai | G09G 3/3233 345/690 |
| 2006/0022925 | A1* | 2/2006 | Hara | G09G 3/3688 345/89 |
| 2008/0284775 | A1* | 11/2008 | Shen | G09G 3/3611 345/214 |
| 2009/0002359 | A1* | 1/2009 | Tamura | G09G 3/3688 345/213 |
| 2009/0009453 | A1* | 1/2009 | Furihata | G09G 3/3685 345/87 |
| 2009/0041348 | A1* | 2/2009 | Someya | G09G 3/2007 382/167 |
| 2009/0153454 | A1* | 6/2009 | Irie | G09G 3/3648 345/89 |
| 2011/0050747 | A1* | 3/2011 | Ishii | G09G 3/3208 345/690 |
| 2011/0148910 | A1* | 6/2011 | Botzas | G09G 5/02 345/600 |
| 2012/0169784 | A1* | 7/2012 | Lee | G09G 3/2011 345/690 |
| 2013/0241914 | A1* | 9/2013 | Kitagawa | G09G 3/3648 345/212 |
| 2013/0257844 | A1* | 10/2013 | Kitagawa | G09G 3/3696 345/212 |
| 2014/0055473 | A1* | 2/2014 | Kikuchi | G09G 5/022 345/531 |
| 2016/0196781 | A1* | 7/2016 | Tanaka | G09G 3/3648 345/691 |

* cited by examiner

| TONE | TONE VOLTAGE |
|---|---|
| 0 | $V_0$ |
| 1 | $V_1$ |
| 2 | $V_2$ |
| 3 | $V_3$ |
| ⋮ | ⋮ |
| 237 | $V_{237}$ |
| ⋮ | ⋮ |
| 255 | $V_{255}$ |

FIG. 2 a1

| INPUT TONE | CORRECTED TONE | TONE VOLTAGE |
|---|---|---|
| 0 | $g_0$ | $V_{g0}$ |
| 1 | $g_1$ | $V_{g1}$ |
| 2 | $g_2$ | $V_{g2}$ |
| 3 | $g_3$ | $V_{g3}$ |
| ⋮ | ⋮ | ⋮ |
| 255 | $g_{255}$ | $V_{g255}$ |

a2

| INPUT TONE | CORRECTED TONE | TONE VOLTAGE |
|---|---|---|
| 0 | $r_0$ | $V_{r0}$ |
| 1 | $r_1$ | $V_{r1}$ |
| 2 | $r_2$ | $V_{r2}$ |
| 3 | $r_3$ | $V_{r3}$ |
| ⋮ | ⋮ | ⋮ |
| 255 | $r_{255}$ | $V_{r255}$ |

a3

| INPUT TONE | CORRECTED TONE | TONE VOLTAGE |
|---|---|---|
| 0 | $b_0$ | $V_{b0}$ |
| 1 | $b_1$ | $V_{b1}$ |
| 2 | $b_2$ | $V_{b2}$ |
| 3 | $b_3$ | $V_{b3}$ |
| ⋮ | ⋮ | ⋮ |
| 255 | $b_{255}$ | $V_{b255}$ |

FIG. 10

| | | TONE | $\alpha$=1.0, $\beta_1$=0 | $\alpha$=0.94, $\beta_1$=0 | $\alpha$=0.94, $\beta_1$=1 | $\alpha$=0.94, $\beta_1$=-1 |
|---|---|---|---|---|---|---|
| | | 49 | 49 | 46 | 46 | 46 |
| | | 50 | 50 | 46.5 | 46.5 | 46.5 |
| | | 51 | 51 | 47 | 47 | 47 |
| | | 52 | 52 | 48 | 48 | 48 |
| | BR1 | 53 | 53 | 49 | 49.5 | 48.5 |
| | | 54 | 54 | 50 | 51 | 49 |
| | | 55 | 55 | 51 | 52 | 50 |
| | | 56 | 56 | 52 | 53 | 51 |
| | | 57 | 57 | 53 | 54 | 52 |
| | | 58 | 58 | 54 | 55 | 53 |
| | | 59 | 59 | 55 | 56 | 54 |
| | | 60 | 60 | 56 | 57 | 55 |
| | | 61 | 61 | 57 | 58 | 56 |
| | | 62 | 62 | 58 | 59 | 57 |
| GCR | MR | 63 | 63 | 59 | 60 | 58 |
| | | 64 | 64 | 60 | 61 | 59 |
| | | 65 | 65 | 61 | 62 | 60 |
| | | 66 | 66 | 62 | 63 | 61 |
| | | 67 | 67 | 62.5 | 63.5 | 61.5 |
| | | 68 | 68 | 63 | 64 | 62 |
| | | 69 | 69 | 64 | 65 | 63 |
| | | 70 | 70 | 65 | 66 | 64 |
| | | 71 | 71 | 66 | 67 | 65 |
| | | 72 | 72 | 67 | 68 | 66 |
| | | 73 | 73 | 68 | 69 | 67 |
| | BR2 | 74 | 74 | 69 | 69.5 | 68.5 |
| | | 75 | 75 | 70 | 70 | 70 |
| | | 76 | 76 | 71 | 71 | 71 |
| | | 77 | 77 | 72 | 72 | 72 |
| | | 78 | 78 | 73 | 73 | 73 |

FIG. 11

| FRAME | SELECTION PATTERN 1 | SELECTION PATTERN 2 |
|---|---|---|
| 0 | 62 | 62 |
| 1 | 63 | 62 |
| 2 | 62 | 63 |
| 3 | 63 | 62 |
| 4 | 62 | 62 |
| 5 | 63 | 63 |
| ⋮ | ⋮ | ⋮ |

FIG. 12

CIRCUIT DEVICE, ELECTRO-OPTICAL DEVICE, AND ELECTRONIC APPARATUS

BACKGROUND

1. Technical Field

The present invention relates to a circuit device, an electro-optical device, an electronic apparatus, and the like.

2. Related Art

Nowadays, color liquid crystal panels (display panels) are often used in electronic apparatuses such as monitors, TVs, and notebook computers. In the color liquid crystal panel, each pixel is constituted by R, G, and B subpixels, for example, and one pixel, as a whole, expresses one color by combining colors of the R, G, and B subpixels. The colors of the R, G, and B subpixels are each determined by the luminance of light that has passed through a color filter provided thereon. The luminance of light that passes through each color filter is determined by a voltage supplied to a corresponding source electrode (data line) of the liquid crystal panel. This voltage is referred to as a tone voltage. The electronic apparatus is provided with a display driver including a circuit device that drives the liquid crystal panel by controlling the tone voltage.

In general, the input (such as an input voltage or an input signal) and the output (such as light transmittance or brightness) in the liquid crystal panel are not in a linear direct proportional relationship. Each liquid crystal panel has its own specific gamma characteristic (luminance characteristic) resulting from the liquid crystal material that is used and variations in manufacturing. Also, in the same liquid crystal panel, R, G, and B gamma characteristics are different. That is, even in the case where the same tone voltage is supplied to each of the R, G, and B subpixels in the same liquid crystal panel, R, G, and B tones are different. Therefore, tone voltages in which consideration is given to the R, G, and B gamma characteristics of the liquid crystal panel need to be supplied to the source electrodes of the liquid crystal panel in order to express desired tones.

For example, in JP-A-2004-29795, a circuit device in which R, G, and B tone voltage generation circuits are separately provided is disclosed. These R, G, and B tone voltage generation circuits respectively generate R, G, and B multiple tone voltages. R, G, and B decoders respectively output voltages selected from the R, G, and B multiple tone voltages based on display data, via amplifiers to the display panel, and as a result, the display panel is driven.

Also, in the known technology in JP-A-2006-39205, tone characteristics of the tone voltages (gamma curves) are corrected by adjusting resistance values of the resistors that constitute a ladder resistor in the tone voltage generation circuit.

In the known technology disclosed in JP-A-2004-29795, since the R, G, and B tone voltage generation circuits are separately provided, the circuit area of the overall tone voltage generation circuit increases. Also, R, G, and B multiple tone voltage lines need to be separately provided, and as a result, the circuit area increases as well. Therefore, in the known technology disclosed in JP-A-2004-29795, the scale of the circuit device increases, which incurs a problem such as an increase in cost.

Therefore, it is desirable that tone voltages that are supplied from the tone voltage generation circuit are used in common for pieces of R, G, and B display data (first color component display data, second color component display data, and third color component display data). In such a case, tone voltages that are to be output need to be selected from the tone voltages that are used in common so as to adapt to the R, G, and B gamma characteristics.

On the other hand, in JP-A-2006-39205, processing in the case where tone voltages generated by the tone voltage generation circuit are used in common for pieces of R, G, and B display data is not disclosed.

Also, in the case where tone voltages generated by the tone voltage generation circuit are used in common for pieces of R, G, and B display data, a case is conceivable where the circuit device supplies tone voltages for at least two color components among R, G, and B tone voltages to the liquid crystal panel at the same time. In this case, when white balance is adjusted, for example, coloring, a tone skip, or the like may occur at a specific tone. That is, tone properties or color reproducibility may degrade at a specific tone. This is caused by, among the tone voltages that are supplied to the liquid crystal panel at the same time, a tone voltage for one piece of color component display data being too high or too low relative to a tone voltage for the other piece of color component display data that is supplied at the same time, or the like.

SUMMARY

According to some aspects of the invention, a circuit device, an electro-optical device, an electronic apparatus, and the like can be provided in which, in the case where tone voltages that are generated by a tone voltage generation circuit are used in common for a plurality of pieces of color component display data, and tone voltages for at least two pieces of color component display data are supplied to a display panel at the same time, degradation of at least one of tone properties and color reproducibility at a specific tone can be suppressed.

One aspect of the invention relates to a circuit device including a tone voltage generation circuit configured to generate a plurality of tone voltages; a data processing unit configured to perform data processing of first color component display data, second color component display data, and third color component display data; and a drive unit configured to drive a display panel based on the first color component display data, the second color component display data, and the third color component display data that have been subjected to the data processing and are obtained from the data processing unit, and the plurality of tone voltages that are obtained from the tone voltage generation circuit and are used in common for the first color component display data, the second color component display data, and the third color component display data, wherein the data processing unit is configured to perform, in a set tone correction range, correction processing for tone on at least one color component display data of the first color component display data, the second color component display data, and the third color component display data.

In one aspect of the invention, the plurality of tone voltages generated by the tone voltage generation circuit are used in common for the first color component display data, the second color component display data, and the third color component display data, and the correction processing for tone is performed, in the set tone correction range, on the at least one color component display data of the first color component display data, the second color component display data, and the third color component display data. Then, a tone voltage, corresponding to a corrected tone, that is selected as the tone voltage corresponding to an input tone is output to a data line drive unit.

Accordingly, in the case where the tone voltages generated by the tone voltage generation circuit are used in common by the plurality of pieces of color component display data, and tone voltages of at least two pieces of color component display data are supplied to the display panel at the same time, degradation of at least one of tone properties and color reproducibility at a specific tone can be suppressed.

Also, one aspect of the invention may include a register for setting the tone correction range.

Accordingly, setting of an arbitrary tone correction range or the like with a command input via an interface unit is made possible.

Also, in one aspect of the invention, the data processing unit may perform multiplication processing in which the at least one color component display data is multiplied by a given coefficient $\alpha$, and perform, in the tone correction range, the correction processing in which a given value $\beta_1$ is added to or subtracted from the color component display data subjected to the multiplication processing.

Accordingly, tone voltages conforming to specific gamma characteristics of the respective color components and a specific gamma characteristic of the display panel can be selected, and suppression of reduction of at least one of tone properties and color reproducibility at a specific tone or the like is made possible.

Also, one aspect of the invention may include a register for setting the given coefficient $\alpha$ and the given value $\beta_1$.

Accordingly, setting the given coefficient $\alpha$ and the given value $\beta_1$ to arbitrary values or the like with a command input via the interface unit is made possible.

Also, in one aspect of the invention, the tone correction range includes: a non-boundary range; and a boundary range between an outside of a tone correction range and the non-boundary range, and the data processing unit may perform, in the non-boundary range, the correction processing on the color component display data subjected to the multiplication processing using the given value $\beta_1$, and perform, in the boundary range, the correction processing using a value $\beta_2$ that is smaller than the given value $\beta_1$.

Accordingly, suppression of degradation of tone properties in the boundary range by suppressing large change in the tone voltage in the boundary range of the tone correction range or the like is made possible.

Also, in one aspect of the invention, the tone correction range may be set with respect to the at least one color component display data of the first color component display data, the second color component display data, and the third color component display data that are to be input to the data processing unit, and be a range between a tone range on a high tone side and a tone range on a low tone side.

Accordingly, a range in which degradation of at least one of tone properties and color reproducibility is apparent to the human eye can be set as the tone correction range.

Also, in one aspect of the invention, the data processing unit may perform, in the case where a corrected tone obtained by the correction processing satisfies a given condition, frame rate control tone control with respect to the corrected tone.

Accordingly, realization of display of an input tone indicated by at least one of the first color component display data, the second color component display data, and the third color component display data in a pseudo manner or the like is made possible.

Also, another aspect of the invention relates to a circuit device including: a tone voltage generation circuit configured to generate a plurality of tone voltages; a data processing unit configured to perform data processing of first color component display data, second color component display data, and third color component display data; and a drive unit configured to drive a display panel based on the first color component display data, the second color component display data, and the third color component display data that are subjected to the data processing and are obtained from the data processing unit, and the plurality of tone voltages that are obtained from the tone voltage generation circuit and are used in common for the first color component display data, the second color component display data, and the third color component display data, wherein the data processing unit is configured to perform correction processing for tone on at least one color component display data of the first color component display data, the second color component display data, and the third color component display data, and, in the case where a corrected tone obtained by the correction processing satisfies a given condition, perform frame rate control tone control with respect to the corrected tone.

Accordingly, in the case where the tone voltages generated by the tone voltage generation circuit are used in common by the plurality of pieces of color component display data, and tone voltages of at least two pieces of color component display data are supplied to the display panel at the same time, degradation of at least one of tone properties and color reproducibility at a specific tone can be suppressed.

Also, in another aspect of the invention, the data processing unit may perform multiplication processing in which the at least one color component display data is multiplied by a given coefficient $\alpha$, as the correction processing.

Accordingly, realization of display of a corrected tone obtained by multiplying an input tone by the given coefficient $\alpha$ such that the tone of one color component display data becomes appropriate relative to the tones of the other pieces of color component display data in a pseudo manner or the like is made possible.

Also, in another aspect of the invention, the data processing unit may perform, in the case where the given condition is satisfied, the frame rate control tone control in which any of a tone resulting from a given difference value being added to or subtracted from the corrected tone and the corrected tone is selected every one or plurality of frames.

Accordingly, expression of a tone corresponding to a tone voltage that is not supplied from the tone voltage generation circuit in a pseudo manner or the like is made possible.

Also, in another aspect of the invention, the data processing unit may obtain an i-th corrected tone by performing the correction processing on an i-th tone (i is an integer that satisfies $0 \le i \le 255$) in the at least one color component display data, obtain a j-th corrected tone by performing the correction processing on a j-th tone (j is an integer that satisfies $j=i+1$) that is next to the i-th tone in the color component display data, and perform the frame rate control tone control in the case where the given condition that the i-th corrected tone and the j-th corrected tone are determined as being the same tone is satisfied.

Accordingly, in the case where the i-th corrected tone and the j-th corrected tone are the same tones, display of the original i-th tone and the original j-th tone so as to be seen as different tones or the like is made possible.

Also, in another aspect of the invention, the data processing unit may perform multiplication processing in which the i-th tone is multiplied by a given coefficient $\alpha$, and obtain the i-th corrected tone by performing rounding processing on an i-th result of the multiplication processing, perform the multiplication processing on the j-th tone, and obtain the j-th corrected tone by performing the rounding processing on a j-th result of the multiplication processing, and perform, in the case where the given condition that the i-th corrected tone and the j-th corrected tone are determined as being the same tone is satisfied, the frame rate control tone control in which any of the i-th corrected tone and a tone resulting from a given difference value being added to or subtracted from the i-th corrected tone is selected every one or plurality of frames.

Accordingly, in the case where the i-th corrected tone and the j-th corrected tone are the same tones, display of the original i-th tone and the original j-th tone so as to be seen as different tones or the like is made possible.

Also, in another aspect of the invention, the tone correction range includes: a non-boundary range; and a boundary range between an outside of a tone correction range and the non-boundary range, and the data processing unit may perform, in the case where the given condition that a tone indicated by the color component display data is included in the boundary range is satisfied, the frame rate control tone control with respect to the corrected tone corresponding to the boundary range.

Accordingly, performing fine tone control in the boundary range of the tone correction range or the like is made possible.

Also, another aspect of the invention may include a register for setting whether the frame rate control tone control is enabled or disabled.

Accordingly, setting of whether the frame rate control tone control is enabled or disabled by a command input via the interface unit or the like is made possible.

Also, in another aspect of the invention, the display panel may be a panel that is provided with a first scan line and a second scan line that are provided so as to be associated with a display line, and includes a first pixel group that is selected by the first scan line and a second pixel group that is selected by the second scan line, and in which data lines of a plurality of data lines are respectively shared by respective pixels in the first pixel group and respective pixels in the second pixel group.

Accordingly, reduction of the number of data lines in the display panel or the like is made possible.

Also, another aspect of the invention relates to an electro-optical device including: the circuit device described above; and the display panel.

Also, another aspect of the invention relates to an electronic apparatus including the circuit device described above.

BRIEF DESCRIPTION OF THE DRAWINGS

The invention will be described with reference to the accompanying drawings, wherein like numbers reference like elements.

FIG. 2 is a diagram for describing tone voltages supplied from a tone voltage generation circuit.

FIG. 10 is a diagram for describing input tones and corrected tones and tone voltages associated therewith.

FIG. 11 is a diagram for describing a specific result of correction processing of tones.

FIG. 12 is a diagram for describing a specific selection pattern of frame rate control tone control.

DESCRIPTION OF EXEMPLARY EMBODIMENTS

Figure 1:
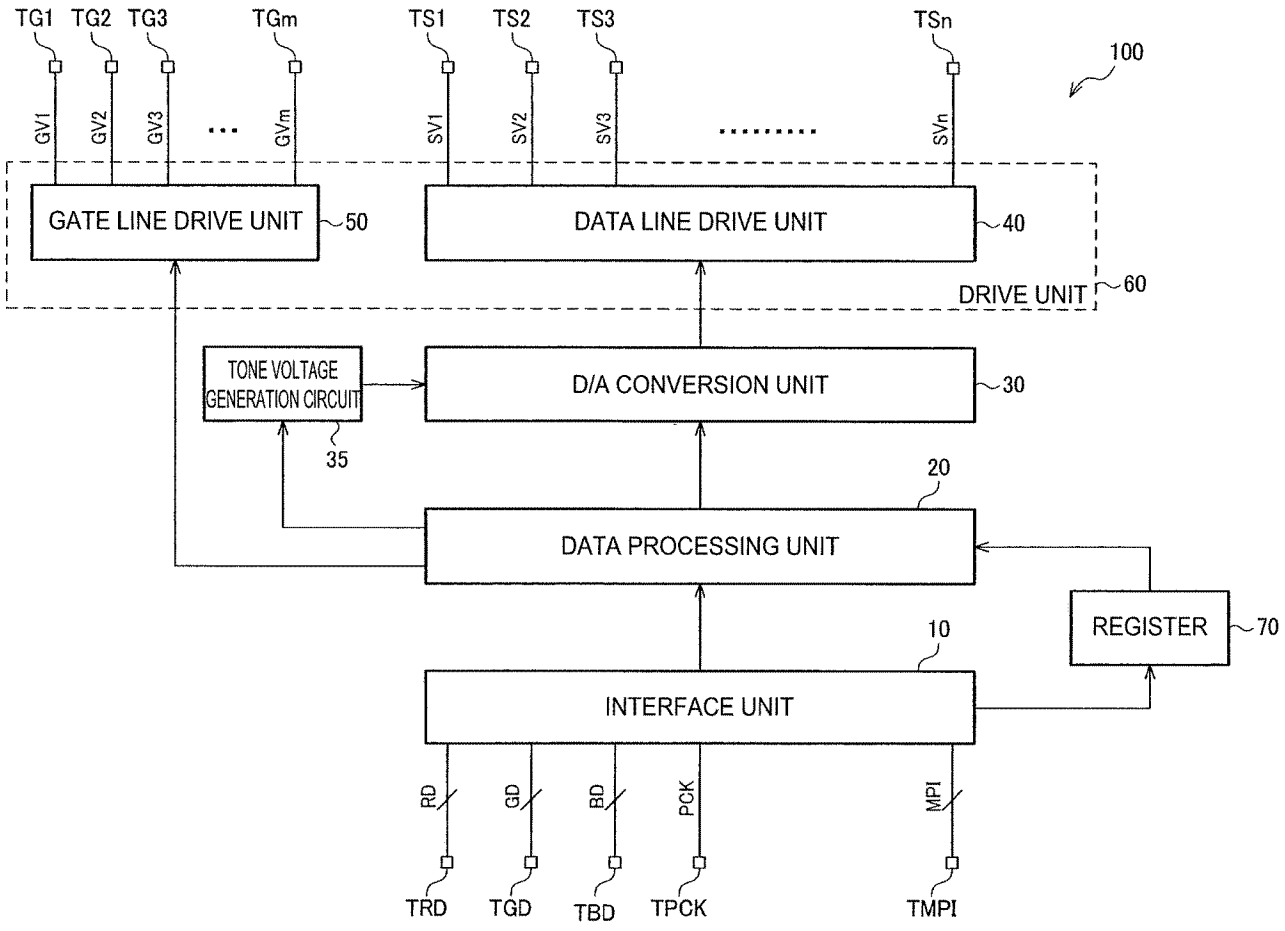
FIG. 1 is a diagram for describing an exemplary configuration of a circuit device of a present embodiment.

Hereinafter, a present embodiment will be described. Note that the present embodiment described below is not intended to unduly limit the content of the invention described in the scope of claims. Also, not all configurations described in the present embodiment are necessarily essential elements of the invention.

1. Outline

As shown in JP-A-2004-29795 described above, when R, G, and B tone voltage generation circuits are separately provided, the circuit area of the overall tone voltage generation circuit increases, which incurs a problem such as an increase in scale and cost of a circuit device.

Therefore, in the present embodiment described below, tone voltages that are supplied from a tone voltage generation circuit are enabled to be used in common for pieces of R, G, and B display data (first color component display data, second color component display data, and third color component display data). Accordingly, an increase in the circuit area of the tone voltage generation circuit and in the number of tone voltage lines is suppressed, and as a result, the size of the circuit device can be decreased (short side of IC is shortened, for example). With this, the cost of manufacturing the circuit device can be reduced as well.

However, because R, G, and B gamma characteristics are different, in order to express the same tone in each of the R, G, and B tones, R, G, and B tone voltages need to be slightly different, in principle. As described above, in the case where the tone voltages are used in common for pieces of R, G, and B display data, when a tone 3 is input by each piece of R, G, and B display data, a same tone voltage $V_3$ is output as each of the R, G, and B tone voltages, as shown in a later-described table in FIG. 2. That is, when a tone m (m is an integer that satisfies $0 \leq m \leq 255$) is input, a same tone voltage $V_m$ is output as each of the R, G, and B tone voltages, and when a tone n (n is an integer that satisfies $0 \leq n \leq 255$, $m \neq n$) is input, a same tone voltage $V_n$ is output as each of the R, G, and B tone voltages, for example. The tone voltages that are output as the R, G, and B tone voltages cannot be said to be respectively conforming to the R, G, and B gamma characteristics, and as a result, high color reproducibility and high tone properties cannot be expected.

Thus, in the present embodiment, tone voltages for respective pieces of color component display data that are to be output are selected from the tone voltages, which are used in common, so as to respectively conform to the R, G, and B gamma characteristics. Specifically, tones (tone values, input tones) that are indicated by the pieces of R, G, and B display data are respectively multiplied by given coefficients $\alpha$ ($\alpha_R$, $\alpha_G$, $\alpha_B$) that are different for the pieces of R, G, and B display data. The given coefficients $\alpha$ ($\alpha_R$, $\alpha_G$, $\alpha_B$) are coefficients that are set with consideration being given to the R, G, and B gamma characteristics, a specific gamma characteristic of a display panel, and the like. A tone voltage corresponding to a tone that is subjected to multiplication of the given coefficient $\alpha$ is used as the tone voltage corresponding to the original input tone. For example, in the case where 3 is input as the G input tone, the input tone 3 is multiplied by the given G coefficient $\alpha_G$, and tone $3\times\alpha_G$ is calculated. Then, a tone voltage $V_{3\times\alpha G}$ corresponding to the tone $3\times\alpha_G$ is selected as the tone voltage corresponding to the original input tone 3. The same applies to the other R and B display data. Accordingly, tone voltages that conform to the R, G, and B gamma characteristics and the specific gamma characteristic of the display panel can be selected and output to the display panel.

Also, in the present embodiment, a liquid crystal panel with a dual gate structure is used as the display panel. In the case where a liquid crystal panel with a dual gate structure is used, the circuit device needs to supply R, G, and B tone voltages to the liquid crystal panel at the same time. For example, as will be described later using FIG. 14, at a timing when a gate line G1 is selected, a data line S1 supplies an R tone voltage to a subpixel SP1R, a data line S2 supplies a B tone voltage to a subpixel SP1B, and a data line S3 supplies a G tone voltage to the subpixel SP2G, at the same time. Also, in the example in FIG. 14, at a timing when a gate line G2 is selected, for example, the data line S1 supplies a G tone voltage to a subpixel SP1G, the data line S2 supplies a R tone voltage to a subpixel SP2R, and the data line S3 supplies B tone voltage to a subpixel SP2B, at the same time.

In the case where the circuit device uses tone voltages generated by the tone voltage generation circuit in common for the pieces of R, G, and B display data, and at least two tone voltages among the R, G, and B tone voltages are supplied to the liquid crystal panel at the same time, as described above, there is a case in which tone properties or color reproducibility degrades at a specific tone. For example, when white balance is adjusted, coloring, tone skip, or the like, for example, may occur at a specific tone. This is because, as will be described later using FIG. 8, the tone voltage for color component display data for one color, among tone voltages that are supplied to the liquid crystal panel at the same time, is too high or too low relative to the tone voltage for another color component display data that is supplied at the same time. For example, in the case where a yellowish color is displayed in one tone even though monochrome display is performed, it is conceivable, as the cause, that the B tone voltage is too low relative to the R and G tone voltages, or the R and G tone voltages are too high relative to the B tone voltage, or the like.

In the present embodiment, as will be described later using FIG. 9, in a tone range (tone correction range) GCR in which degradation in tone properties and color reproducibility is highly possible, a corrected tone is calculated by, after the aforementioned input tone having been multiplied by a given coefficient $\alpha$, adding or subtracting a given value $\beta_1$ to or from the multiplication result. Then, the tone voltage corresponding to the calculated corrected tone is selected as the tone voltage of the input tone, and the tone voltage is output to the display panel. For example, in an example in the right end column in the table in later-described FIG. 11, each tone in the tone correction range GCR in which tones from 53 to 74 are included is multiplied by $\alpha$=0.94, processing for rounding down to an integer is performed on the multiplication result, $\beta_1$=−1 is added, and as a result, the corrected tone is calculated. The given value $\beta_1$ is a value used for performing adjustment such that the tone voltage for color component display data for one color becomes a tone voltage corresponding to the tone voltages for other pieces of color component display data that are supplied at the same time, and can be set to an arbitrary value.

Accordingly, in the case where tone voltages generated by the tone voltage generation circuit are used in common for a plurality of pieces of color component display data, and tone voltages for at least two pieces of color component display data are supplied to the display panel at the same time, degradation of at least one of tone properties and color reproducibility at a specific tone can be suppressed.

Also, in the present embodiment, by performing frame rate control tone control (hereinafter referred to as FRC (Frame Rate Control)) as well, tone properties and color reproducibility at a specific tone is improved. Specifically, the FRC is performed in the case where the corrected tone obtained by performing processing for rounding down to an integer on a calculated result resulting from an input tone being multiplied by the given coefficient $\alpha$ is the same as the corrected tone above or below thereof in the table. For example, as shown in FIG. 11, in the case where the corrected tone with respect to the input tone 67 is 62, and the corrected tone with respect to the input tone 66 is also 62, the FRC is performed when input tone 67 is input. In the FRC, as shown in later-described FIG. 12, for example, a selected tone is changed every frame so as to realize display of a tone including a decimal point such as 62.5 by using an afterimage effect in a pseudo manner. With this as well, as described above, degradation of at least one of tone properties and color reproducibility at a specific tone can be suppressed.

2. Circuit Device

An exemplary configuration of a circuit device 100 (display driver) of the present embodiment is shown in FIG. 1. The circuit device 100 includes an interface unit 10 (interface circuit), a data processing unit 20 (data processing circuit), a tone voltage generation circuit 35, a D/A conversion unit 30 (D/A conversion circuit), a drive unit 60 (drive circuit), a register 70, a first color component input terminal TRD, a second color component input terminal TGD, a third color component input terminal TBD, a clock input terminal TPCK, an interface terminal TMPI, data line drive terminals TS1 to TSn (n is an integer of two or more), and gate line drive terminals TG1 to TGm (m is an integer of two or more). The drive unit 60 includes a data line drive unit 40 (data line drive circuit) and a gate line drive unit 50 (gate line drive circuit). The circuit device 100 is realized by an integrated circuit device (IC) or the like, for example. Note that the circuit device 100 is not limited to the configuration of FIG. 1, and various modifications are possible, such as omitting some of these constituent elements or adding other constituent elements.

The interface unit 10 performs communication with an external processing device (display controller such as an MPU, a CPU, or an ASIC). The communication is for transferring image data, supplying a clock signal and a synchronous signal, transferring a command (or a control signal), and the like. Also, the interface unit 10 accepts a terminal setting (input level of a terminal set on a mount substrate). The interface unit 10 is constituted by an I/O buffer or the like, for example.

The data processing unit 20 performs data processing of image data, timing control, control of units of the circuit device 100, and the like, based on image data, a clock signal, a synchronous signal, a command, and the like that are input via the interface unit 10. In the data processing of image data, image processing such as correction processing of a tone indicated by color component display data such as first color component display data, second color component display data, third color component display data, or the like, is performed, for example. In the timing control, drive timing (selection timing) of a gate line and a data line in a display panel is controlled based on the synchronous signal and the image data. The data processing unit 20 is constituted by a logic circuit such as a gate array, for example.

The tone voltage generation circuit 35 generates a plurality of tone voltages and outputs the tone voltages to the D/A conversion unit 30. For example, as shown in the table in FIG. 2, generated tone voltages ($V_0$ to $V_{255}$) respectively correspond to a plurality of tones (0 to 255). Also, in the present embodiment, because the tone voltages output from the tone voltage generation circuit 35 are used in common for a plurality of pieces of color component display data (such as first color component display data, second color component display data, and third color component display data, for example), the tone voltage generation circuit 35 need not be provided for each color component display data. In this way, as a result of adopting a configuration in which the plurality of tone voltages generated by the tone voltage generation circuit 35 are used in common for the first color component display data, the second color component display data, and the third color component display data, the circuit area of the tone voltage generation circuit 35 can be reduced, the interconnect area of tone voltage lines can be reduced, and as a result, reduction in the scale of the circuit device can be realized.

The D/A conversion unit 30 D/A-converts image data (input tone) from the data processing unit 20 into a tone voltage (data voltage). The D/A conversion unit 30 includes a D/A conversion circuit 32 (plurality of voltage selection circuits), for example. The D/A conversion circuit 32 selects a tone voltage corresponding to the image data (input tone) from the plurality of tone voltages from the tone voltage generation circuit 35. For example, as shown in later-described FIG. 4, the tone voltage generation circuit 35 is constituted by a ladder resistor or the like, and the D/A conversion circuit 32 is constituted by a switch circuit or the like. Specific configurations of the tone voltage generation circuit 35 and the D/A conversion circuit 32 will be described later in detail using FIGS. 4 to 6.

The drive unit 60 drives the display panel based on the first color component display data, the second color component display data, and the third color component display data that have been subjected to data processing, and have been obtained from the data processing unit 20, and the plurality of tone voltages that are used in common for the first color component display data, the second color component display data, and the third color component display data, and have been obtained from the tone voltage generation circuit 35.

The data line drive unit 40 in the drive unit 60 outputs data line drive voltages SV1 to SVn respectively to the data line drive terminals TS1 to TSn based on the tone voltages from the D/A conversion unit 30, and drives the data lines in the display panel. The data line drive voltages SV1 to SVn are voltages that are respectively supplied to the corresponding data line drive terminals TS1 to TSn. One voltage from the tone voltages ($V_0$ to $V_{255}$, for example) that are generated by the tone voltage generation circuit 35 is selected by the D/A conversion unit 30 based on the image data, as a voltage for each of the data line drive voltages SV1 to SVn.

Also, the data line drive unit 40 includes a plurality of data line drive circuits that are provided so as to correspond to the plurality of data line drive terminals. Each data line drive circuit is provided so as to correspond to one data line drive terminal or a plurality of data line drive terminals. In the case where a data line drive circuit is provided so as to correspond to a plurality of data line drive terminals, the data line drive circuit drives the plurality of data lines in a time division manner. Note that the D/A conversion circuits 32 are provided in one-to-one correspondence with the data line drive circuits in the D/A conversion unit 30.

The gate line drive unit 50 in the drive unit 60 outputs gate line drive voltages GV1 to GVm respectively to the gate line drive terminals TG1 to TGm, and drives (selects) gate lines in the display panel. For example, in a display panel with a single gate structure, one gate line is selected in one horizontal scanning period. Alternatively, in a display panel with a dual gate structure or a triple gate structure, two or three gate lines are selected in one horizontal scanning period in a time division manner. The gate line drive unit 50 is constituted by a plurality of voltage output circuits (buffers, amplifiers), for example, and the voltage output circuits are provided in one-to-one correspondence with the gate line drive terminals.

Figure 3:
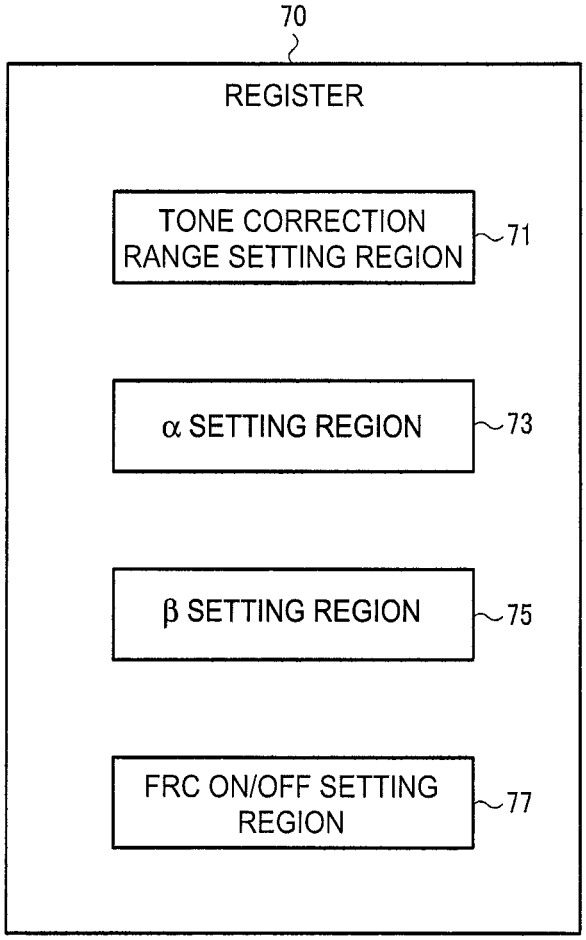
FIG. 3 is a diagram for describing an exemplary configuration of a register.

A register (storage circuit) 70 can set a tone correction range, a given coefficient $\alpha$, a given value $\beta_1$, and whether the frame rate control tone control is enabled or disabled, which will be described later in detail, and the like. For example, the register 70 includes a tone correction range setting region 71 for setting the tone correction range, an a setting region 73 for setting the given coefficient $\alpha$, a $\beta$ setting region 75 for setting the given value $\beta_1$, and an FRC ON/OFF setting region 77 for setting ON/OFF of the frame rate control tone control, as shown in FIG. 3. The register 70 can be realized by a latch, a RAM, a nonvolatile memory, a fuse, or the like, for example. The nonvolatile memory can be realized by an OTP (One Time Programmable) circuit or the like, for example. The OTP circuit is constituted by a memory cell including a memory transistor having a floating gate and a latch circuit for holding bit data that is written into the memory transistor, and is a so-called nonvolatile memory into which writing is possible once, for example.

In the case where the register 70 is accessible from an external processing device (latch or RAM), for example, commands that are input to the interface unit 10 from the interface terminal TMPI includes various settings such as the tone correction range, the given coefficient $\alpha$, the given value $\beta_1$, whether the frame rate control tone control is enabled or disabled. The interface unit 10 that has accepted these commands, writes the various settings included in the commands into the register 70. Alternatively, in the case where the register 70 is a nonvolatile memory or a fuse, various settings such as the tone correction range, the given coefficient $\alpha$, and the given value $\beta_1$ are set to the nonvolatile memory or the fuse at the time of manufacturing, for example. The data processing unit 20 reads out various settings from the register 70, and performs various types of processing.

Accordingly, setting of an arbitrary tone correction range or the like is made possible by a command or the like that is input via the interface unit 10, for example. Similarly, by using a command or the like that is input via the interface unit 10, for example, setting of the given coefficient $\alpha$ and the given value $\beta_1$ to arbitrary values or the like is made possible, and setting of whether the frame rate control tone control is enabled or disabled or the like is made possible.

3. Tone Voltage Generation Circuit and D/A Conversion Circuit

Figure 4:
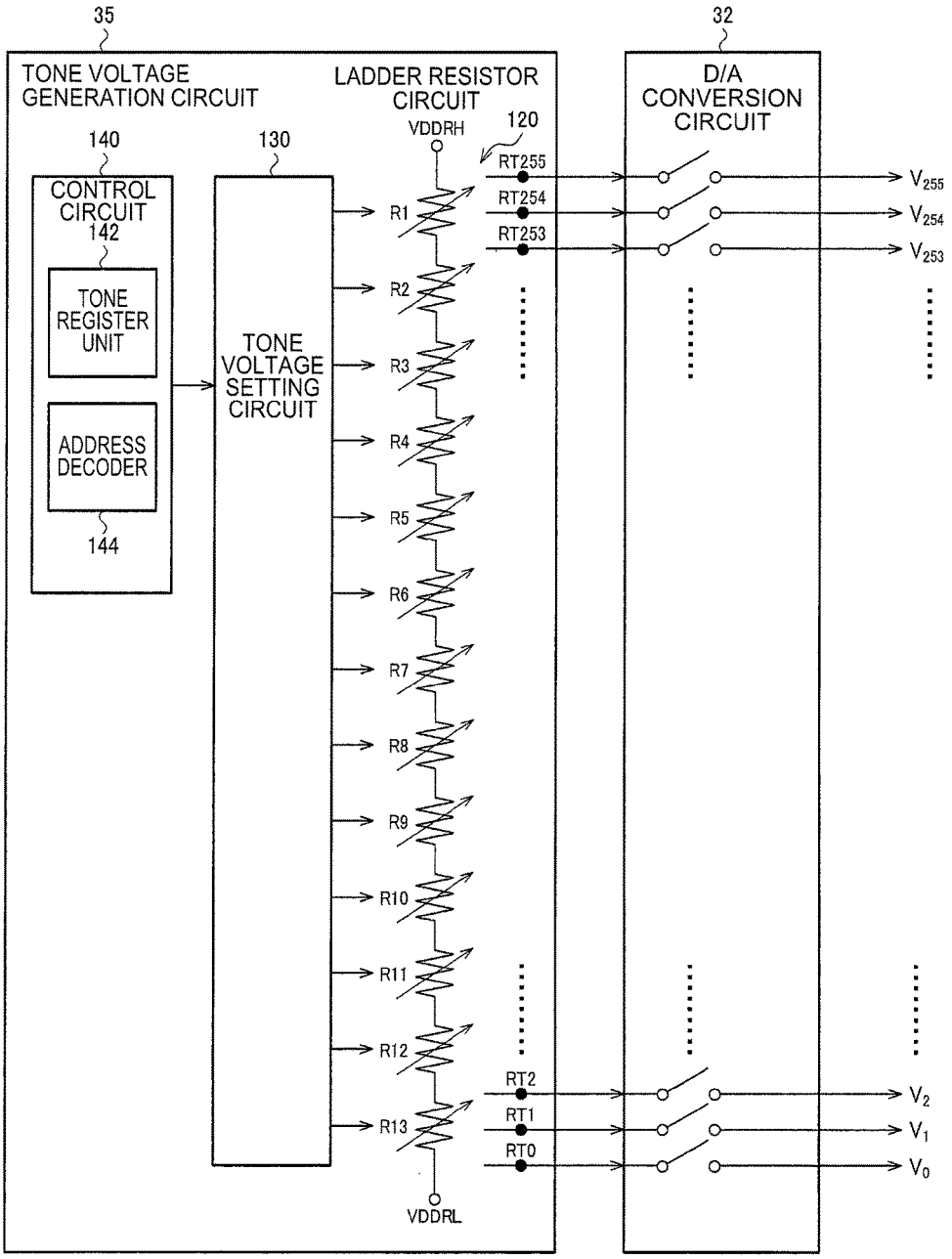
FIG. 4 is a diagram for describing a specific exemplary configuration of the tone voltage generation circuit and a D/A conversion circuit.

An exemplary configuration of the tone voltage generation circuit 35 and the D/A conversion circuit 32 is shown in FIG. 4. The tone voltage generation circuit 35 includes a ladder resistor circuit 120, a tone voltage setting circuit 130, and a control circuit 140. The D/A conversion circuit 32 is constituted by a switch circuit or the like.

Here, the ladder resistor circuit 120 divides the voltage between a high potential side power supply (power supply voltage) VDDRH and a low potential side power supply (power supply voltage) VDDRL by using resistors with thirteen variable resistance circuits (R1 to R13), for example, and outputs a plurality of tone voltages $V_0$ to $V_{255}$ to a respective plurality of resistance division nodes RT0 to RT255. In FIG. 4, a case of 256 tones is illustrated, for example, and V; (i is an integer that satisfies $0 \leq i \leq 255$) indicates a tone voltage corresponding to a tone value i. Note that, although a case of 256 tones will be described in the following description as well, the present embodiment is not limited thereto.

The control circuit 140 includes a tone register unit 142 and an address decoder 144. Tone adjustment data (data for adjusting a tone characteristic) from the data processing unit 20 (logic circuit) is written into the tone register unit 142. The address decoder 144 decodes an address signal from the logic circuit, and outputs a register address signal corresponding to the address signal. In the tone register unit 142, the tone adjustment data is written into the register whose register address signal from the address decoder 144 is active, based on a latch signal from the logic circuit.

The tone voltage setting circuit 130 (tone selector) variably sets (controls) tone voltages that are output to the resistance division nodes RT0 to RT255 based on the tone adjustment data written into the tone register unit 142. Specifically, for example, the tone voltages are variably set by variably controlling the resistance values of the plurality of variable resistance circuits (R1 to R13) included in the ladder resistor circuit 120.

Also, the D/A conversion circuit 32 performs ON/OFF control on the switch circuit based on the image data, selects a tone voltage necessary for displaying the image data from the plurality of tone voltages $V_0$ to $V_{255}$ that are output from the tone voltage generation circuit 35, and outputs the selected tone voltage to the data line drive unit 40.

Note that the tone voltage generation circuit and the D/A conversion circuit are not limited to the configuration of FIG. 4, and various modifications are possible. Some of the constituent elements in FIG. 4 may be omitted, or other constituent elements may be added. For example, a positive polarity ladder resistor circuit and a negative polarity ladder resistor circuit may be provided. A circuit (operational amplifier with a voltage follower connection) that performs impedance conversion of the tone voltage signal may be provided. Alternatively, the tone voltage generation circuit may include a selection voltage generation circuit and a tone voltage selection circuit. In this case, voltages divided by a ladder resistor circuit included in the selection voltage generation circuit are output as a plurality of selection voltages. The tone voltage selection circuit selects 256 (S, in a broad sense) voltages in the case of 256 tones, for example, from the selection voltages from the selection voltage generation circuit according to tone adjustment data, and outputs selected voltages as tone voltages $V_0$ to $V_{255}$.

Figure 5:
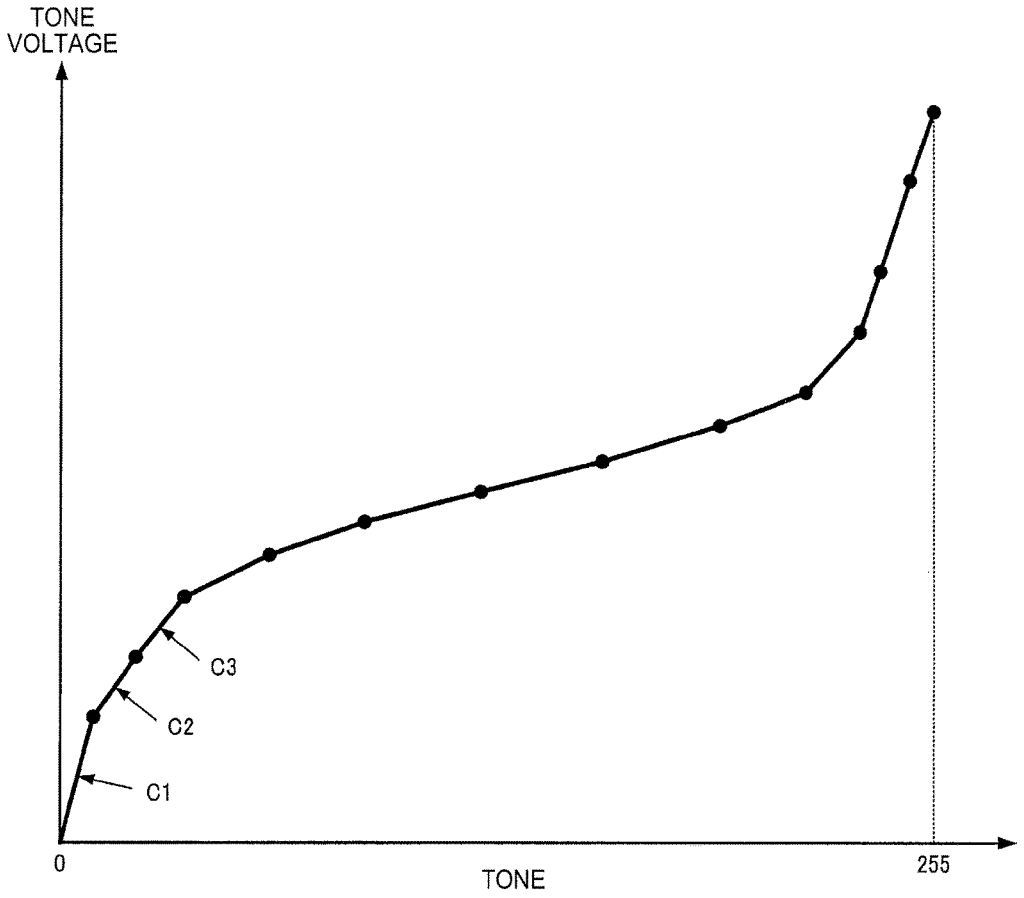
FIG. 5 is a diagram for describing a tone characteristic.

In the tone voltage generation circuit 35 in FIG. 4, the tone characteristics are adjusted by variably controlling slopes of the tone characteristics in respective sections that are indicated by C1, C2, C3, and the like shown in FIG. 5. The control of the slope of the tone characteristics in each section can be realized by controlling the resistance value of the variable resistance circuit in the ladder resistor circuit 120 corresponding to the section.

Figure 6:
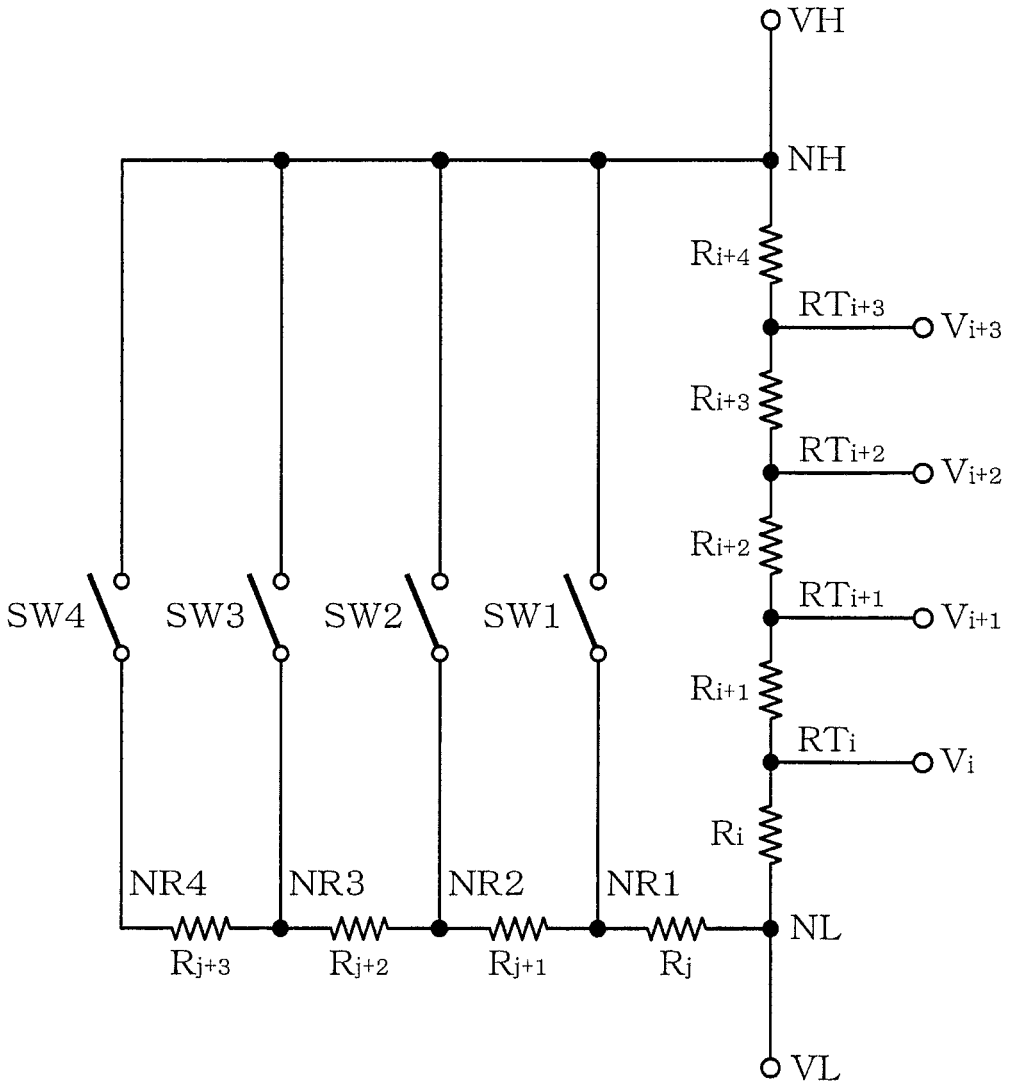
FIG. 6 is a diagram for describing a variable resistance circuit included in the tone voltage generation circuit.

Next, an exemplary configuration of the variable resistance circuit included in the ladder resistor circuit 120 is shown in FIG. 6. In the ladder resistor circuit 120, a plurality of the variable resistance circuits having the configuration shown in FIG. 6 are provided in series between a high potential side power supply VDDRH and a low potential side power supply VDDRL. A node VH in FIG. 6 is a node on the high potential side power supply VDDRH side, and a node VL is a node on the low potential side power supply VDDRL side.

In FIG. 6, a plurality of resistors $R_{i+4}$ to $R_i$ are provided in series between the node NH, which is a connection node with an upper (upstream) variable resistance circuit, and the node NL, which is a connection node with a lower (downstream) variable resistance circuit. Nodes between these resistors $R_{i+4}$ to $R_i$ are respectively resistance division nodes $RT_{i+3}$ to $RT_i$, and tone voltages $V_{i+3}$ to $V_i$ are respectively generated and output at the resistance division nodes $RT_{i+3}$ to $RT_i$.

Switching elements SW1, SW2, SW3, SW4 each constituted by a transistor are respectively provided between the node NH and nodes NR1, NR2, NR3, and NR4. Also, adjustment resistors $R_j$, $R_{j+1}$, $R_{j+2}$, and $R_{j+3}$ are respectively provided between the nodes NR1 and NL, between the nodes NR2 and NR1, between the nodes NR3 and NR2, and between the nodes NR4 and NR3.

The total resistance value between the nodes NH and NL is changed by performing ON/OFF control on the switching elements SW1 to SW4, in FIG. 6. For example, in the case where the switching elements SW1 to SW4 are all OFF, the total resistance value between the nodes NH and NL is $R_{i+4}+R_{i+3}+R_{i+2}+R_{i+1}+R_i$. Meanwhile, when only the switching element SW1 is turned on, the total resistance value between the nodes NH and NL is a parallel resistance value of $R_{i+4}+R_{i+3}+R_{i+2}+R_{i+1}+R_i$ and $R_j$. Also, when only the switching element SW2 is turned on, the total resistance value between the nodes NH and NL is a parallel resistance value of $R_{i+4}+R_{i+3}+R_{i+2}+R_{i+1}+R_i$ and When the ON/OFF control of the switching elements SW1 to SW4 is performed and the total resistance value between the nodes NH and NL is changed, as described above, the slope in the tone characteristics in FIG. 5 in the section corresponding to the variable resistance circuit changes. Accordingly, the tone characteristics can be variably controlled. In this case, the tone voltage setting circuit 130 in FIG. 4 generates a switching signal for controlling ON/OFF of the switching elements SW1 to SW4 based on tone adjustment data written into the tone register unit 142, and outputs the switching signal to the ladder resistor circuit 120.

4. Details of Processing

Next, details of processing of the present embodiment will be described. In the present embodiment, as described above, in order to make the tone voltages appropriate for the R, G, and B gamma characteristics and the specific gamma characteristics of the display panel, tone voltages to be output are selected from the tone voltages that are used in common. Specifically, input tones indicated by pieces of R, G, and B display data are respectively multiplied by the given R, G, and B coefficients $\alpha$ ($\alpha_R$, $\alpha_G$, $\alpha_B$) that are different from each other. Then, the tone voltage corresponding to the tone obtained by performing multiplication of the given coefficient $\alpha$ is the tone voltage associated with the original input tone.

Here, the given coefficients $\alpha$ ($\alpha_R$, $\alpha_G$, $\alpha_B$) are coefficients that are used to multiply the input tones, and are coefficients that are set with consideration given to the R, G, and B gamma characteristics, the specific gamma characteristics of the display panel, and the like, for example. The given coefficients $\alpha$ can be set to the register 70 by inputting a command to the interface unit 10, as described above. The R, G, and B given coefficients $\alpha$ are envisioned to be individual values, but the given coefficients $\alpha$ are not limited thereto, and may be common for two pieces of color component display data.

Figure 7:
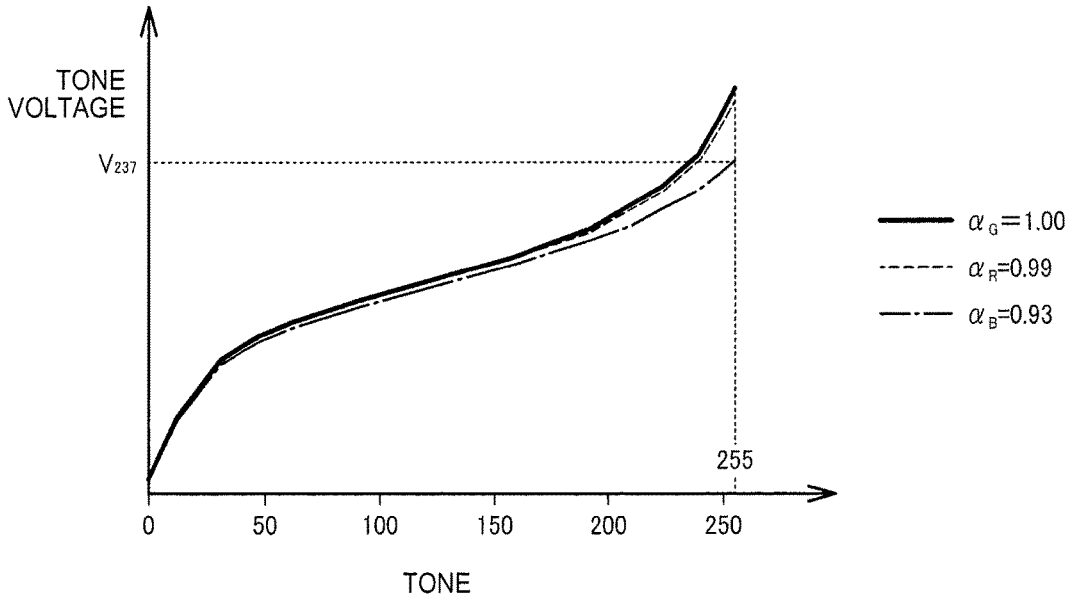
FIG. 7 is a diagram for describing tone characteristics when being multiplied by a given coefficient $\alpha$.

The relationship between the input tone and the tone voltage in this case is illustrated in the graph in FIG. 7. In the graph in FIG. 7, the horizontal axis indicates the input tone (tone) and the vertical axis indicates the tone voltage corresponding to the input tone. The tone voltage in the vertical axis is determined based on a tone obtained by performing multiplication processing of the given coefficient $\alpha$ on the input tone. Also, in the example in FIG. 7, $\alpha_R$=0.99, $\alpha_G$=1.00, and $\alpha_B$=0.93 are used. For example, in the example in FIG. 7, in the case where the B input tone is 255, the tone subjected to multiplication of $\alpha_B$ is 237 (subjected to rounding down to an integer). Then, a tone voltage $V_{237}$ corresponding to the tone 237 is selected based on the aforementioned correspondence table in FIG. 2, and the tone voltage $V_{237}$ is supplied to the display panel as the tone voltage associated with a B input tone 255.

Also, in the present embodiment, a liquid crystal panel with a dual gate structure is used as the display panel, as described above. In the case of using a liquid crystal panel with a dual gate structure, the circuit device 100 supplies the R, G, and B tone voltages to the liquid crystal panel at the same time, as will be described later using FIG. 14.

In the case where the circuit device 100 uses tone voltages generated by the tone voltage generation circuit 35 in common for the pieces of R, G, and B display data, and at least two tone voltages among the R, G, and B tone voltages are supplied to the liquid crystal panel at the same time, as described above, there is a case in which tone properties or color reproducibility degrades at a specific tone. For example, when white balance is adjusted, coloring, tone skip, or the like, may occur at a specific tone.

This is because the tone voltage for color component display data for one color, among tone voltages that are supplied to the liquid crystal panel at the same time, is too high or too low relative to the tone voltage for the other color component display data that is supplied at the same time.

Figure 8:
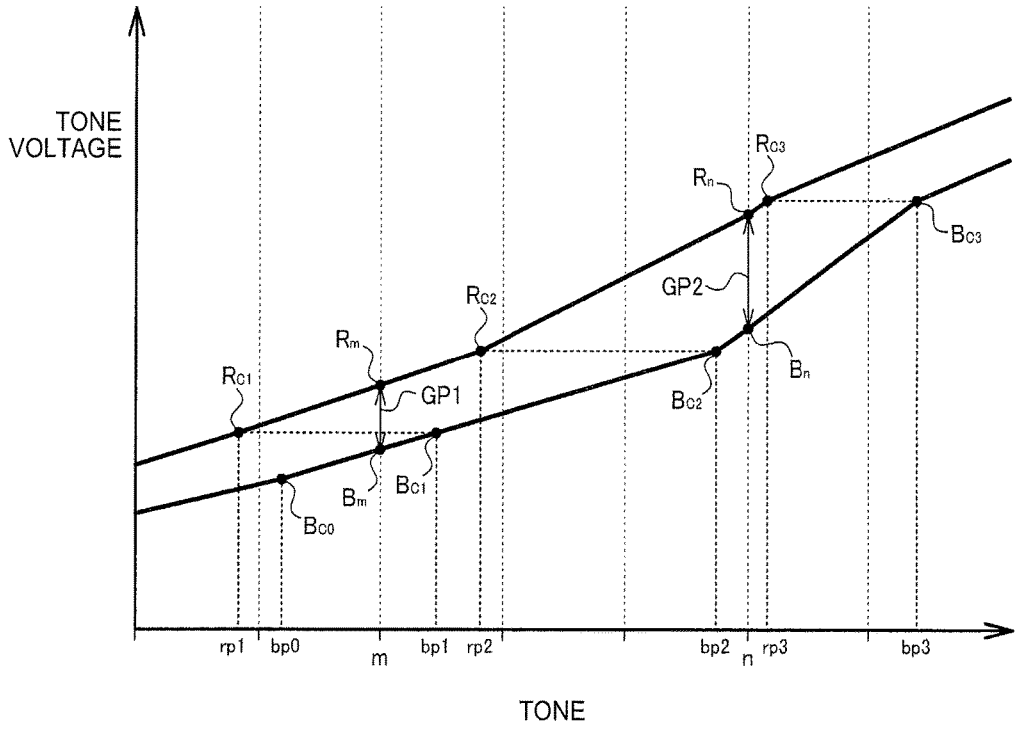
FIG. 8 is a diagram for describing a relationship between R and B input tones and R and B tone voltages, respectively, in one tone range.

Here, a relationship between the R and B input tones and the tone voltages in a certain tone range is shown in the graph in FIG. 8, for example. The input tones indicated in the horizontal axis in FIG. 8 are a portion of all tones, and are illustrated in an enlarged form. Also, the tone voltage in the vertical axis is, similar to the graph in FIG. 7, the tone voltage corresponding to the tone obtained by multiplying the input tone by the given coefficient $\alpha$ ($\alpha_R$, $\alpha_B$). Because an integer is input as the tone in the horizontal axis in FIG. 8, the tone voltages in the vertical axis take discrete values. For example, the tone voltages ($V_{49}$, $V_{50}$, $V_{51}$, etc.) are respectively obtained from the tones (49, 50, 51, etc.). Each polygonal line representing the relationship between the input tone and the tone voltage in FIG. 8 is obtained by connecting points corresponding to each of the tone voltages.

Also, the points $R_{C1}$, $R_{C2}$, $R_{C3}$, $B_{C0}$, $B_{C1}$, $B_{C2}$, and $B_{C3}$ in FIG. 8 represent change points in the tone characteristics, as described above using FIG. 5, and the tone characteristic (slope of the graph) after each of the points $R_{C1}$, $R_{C2}$, $R_{C3}$, $B_{C0}$, $B_{C1}$, $B_{C2}$, and $B_{C3}$ changes from that prior to the change point. Note that description of the G tone characteristic is omitted to simplify description.

In such a case, depending on the combination of given coefficients $\alpha_R$ and $\alpha_B$, an input tone corresponding to a change point in the R tone characteristic (slope of the graph) differs from that in the B tone characteristic. For example, although the R tone characteristic changes at input tones rp1, rp2, and rp3 respectively corresponding to the change points $R_{C1}$, $R_{C2}$, and $R_{C3}$, the B tone characteristic does not change at any of the input tones rp1, rp2, and rp3. On the other hand, the B tone characteristic changes at input tones bp0, bp1, bp2, and bp3 respectively corresponding to the change points $B_{C0}$, $B_{C1}$, $B_{C2}$, and $B_{C3}$. That is, the degree of change of the R tone changes at tones rp1, rp2, and rp3, meanwhile, the degree of change of the B tone changes at the tones bp0, bp1, bp2, and bp3.

As a result, even if, at tone m, a $B_m$ tone voltage is an appropriate voltage relative to an $R_m$ tone voltage, at tone n, a $B_n$ tone voltage may be too low relative to an $R_n$ tone voltage (m and n are integers that satisfy $0 \leq m < n255$). In the example in FIG. 8, the difference between $R_m$ and $B_m$ is GP1, meanwhile, the difference between $R_n$ and $B_n$ is GP2, which is larger than GP1. In this case, assuming that the G input tone is the same as the R and B input tones, even if an appropriate grey is displayed at a tone m, a yellowish color may be displayed at a tone n. This problem is apparent when the tone voltages supplied from the tone voltage generation circuit 35 are used in common for the pieces of R, G, and B display data, and R, G, and B tone voltages are output at the same time. Note that, although in the example in FIG. 8, a case where the B tone voltage is too low relative to the R tone voltage has been described as an example, other than this, a similar phenomenon can be observed in a case where the B tone voltage is too low relative to the G tone voltage, or the R and G tone voltages are too high relative to the B tone voltage.

Figure 9:
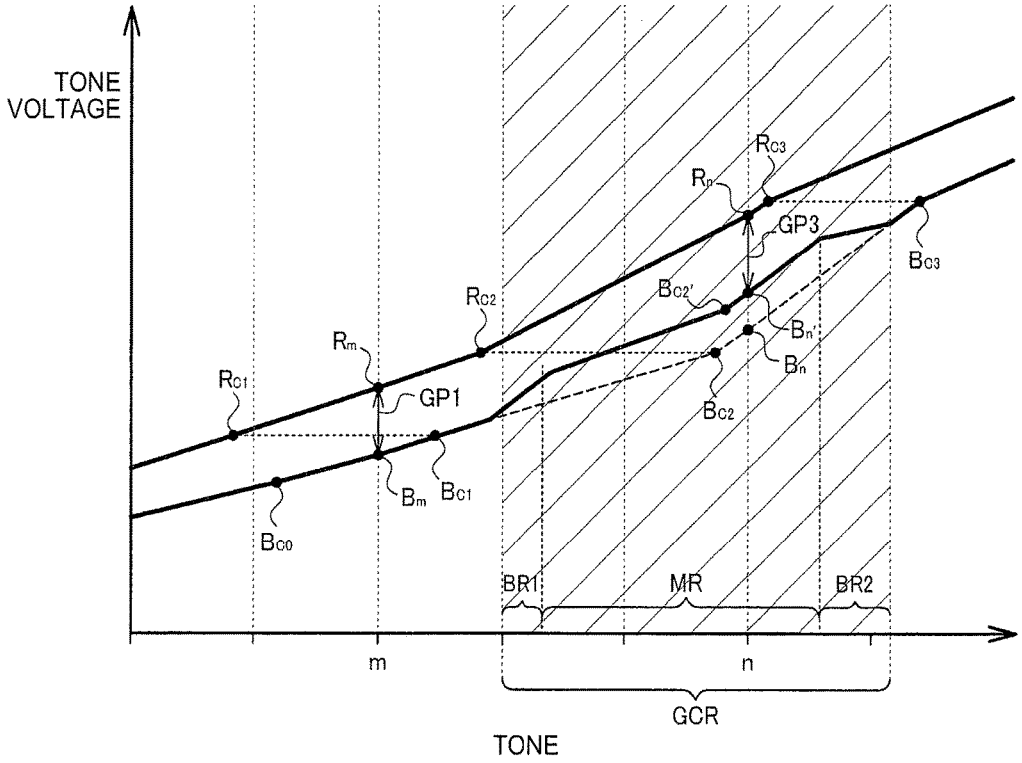
FIG. 9 is a diagram for describing tone voltages after performing correction processing on B tones.

Therefore, in the present embodiment, as shown in FIG. 9, tone correction processing is performed so as to calculate a corrected tone in a tone range (tone correction range) GCR in which degradation in tone properties or color reproducibility is highly possible. Hereinafter, the tone that is obtained as a result of the correction processing will be referred to as a corrected tone. The tone voltage corresponding to the calculated corrected tone is selected as the tone voltage with respect to the input tone, and the tone voltage is output to the display panel. FIG. 9 is a graph similar to the graph in FIG. 8, and the tone characteristic when the B tone correction processing is performed is shown. In an example shown in FIG. 9, a B corrected tone with respect to an input tone n is calculated, for example, and the difference between points $B_{n'}$ and $R_n$ corresponding to the tone voltages of the tone n is improved to GP3, which is smaller than GP2 shown in FIG. 8.

At this time, the data processing unit 20 performs the tone correction processing in a set tone correction range on at least one color component display data from the first color component display data, the second color component display data, and the third color component display data.

Here, the first color component display data refers to the R display data, for example, and is the display data RD that is input to the interface unit 10 from the first color component input terminal TRD shown in FIG. 1. Also, the second color component display data refers to the G display data, for example, and is the display data GD that is input to the interface unit 10 from the second color component input terminal TGD shown in FIG. 1. Also, the third color component display data refers to the B display data, for example, and is the display data BD that is input to the interface unit 10 from the third color component input terminal TBD shown in FIG. 1.

For example, in the case where the display panel is controlled with 256 tones, each piece of color component display data includes information indicating any of tones 0 to 255. Hereinafter, each tone designated by each piece of color component display data is referred to as an input tone. Note that the present embodiment is not limited to 256 tones.

In the case where the display data RD of one pixel (or one subpixel) is constituted by eight bits (eight bits at the maximum), for example, the input terminal TRD is actually constituted by eight terminals, and 8-bit display data RD is input via the eight terminals. Pieces of display data RD of a plurality of pixels are serially input in synchronization with a clock signal PCK (pixel clock) that is input from the clock input terminal TPCK. The same applies to the display data GD and BD.

Note that, in the present embodiment, although a case is described where pieces of the color component display data for three colors are input, the present embodiment is not limited thereto. For example, in the case where pieces of the color component display data for four colors are input, W (white) color component display data or Y (yellow) color component display data may be input, in addition to pieces of R, G, and B color component display data. Also, the pieces of color component display data for three colors are not limited to the pieces of R, G, and B display data, and an arbitrary combination of pieces of color component display data can be used.

In the present embodiment, as described above, the plurality of tone voltages generated by the tone voltage generation circuit 35 are used in common for the first color component display data, the second color component display data, and the third color component display data. In such a configuration, the tone correction processing is performed on at least one color component display data from the first color component display data, the second color component display data, and the third color component display data in a set tone correction range. For example, as shown in the example in FIG. 10A1, the correction processing is performed on G input tones (0 to 255), and the corrected tones ($g_0$ to $g_{255}$) are calculated. Note that, in the present example, the correction processing may be multiplication processing of a given coefficient $\alpha$, or addition processing or subtraction processing of a given coefficient $\beta_1$ ($\beta_2$). Also, for example, for R and B colors as well, corrected tones ($r_0$ to $r_{255}$, $b_0$ to $b_{255}$) are similarly calculated as shown in FIGS. 10A2 and 10A3. As shown in FIGS. 10A1 to 10A3, the D/A conversion unit 30 selects the tone voltages ($V_{g0}$ to $V_{g255}$, $V_{r0}$ to $V_{1255}$, $V_{b0}$ to $V_{b255}$) corresponding to the corrected tones ($g_0$ to $g_{255}$, $r_0$ to $r_{255}$, $b_0$ to $b_{255}$) as the tone voltages corresponding to the input tones (0 to 255), and outputs the selected tone voltages to the data line drive unit 40. The data line drive unit 40 supplies the input tone voltages to the display panel. Accordingly, the display panel can realize a display with the same tone as the input tone, or at least with a tone closer to the input tone compared with the case where the tone correction processing has not been performed.

Accordingly, in the case where tone voltages generated by the tone voltage generation circuit are used in common for a plurality of pieces of color component display data, and tone voltages for at least two pieces of color component display data are supplied to the display panel at the same time, degradation of at least one of tone properties and color reproducibility at a specific tone can be suppressed.

Next, the tone correction processing will be specifically described. The data processing unit 20 performs, on color component display data for at least one color, multiplication processing in which the color component display data is multiplied by a given coefficient $\alpha$, and correction processing, in a tone correction range, in which a given value $\beta_1$ is added to or subtracted from the color component display data subjected to the multiplication processing. Note that the multiplication processing may include processing of rounding down to an integer.

That is, the corrected tone $g_i$ shown in FIG. 10A1 is obtained by $g_i = i \times \alpha_G \pm \beta_{1G}$. Similarly, the corrected tone $r_i$ shown in FIG. 10A2 is obtained by $r_i = i \times \alpha_R \pm \beta_{1R}$, and the corrected tone $b_i$ shown in FIG. 10A3 is obtained by $b_i = i \times \alpha_B \pm \beta_{1B}$. i indicates the input tone and satisfies $0 \leq i \leq 255$. Also, $\beta_{1R}$, $\beta_{1G}$, and $\beta_{1B}$ are respectively R, G, and B given values $\beta_1$.

Here, the given value $\beta_1$ is a value used to adjust the tone voltage of one color component display data so as to become a tone voltage appropriately corresponding to the tone voltages of the other pieces of color component display data that are supplied at the same time, and can be set to an arbitrary value. The tone voltage appropriately corresponding to the tone voltages of the other pieces of color component display data that are supplied at the same time, in particular, is a tone voltage with which coloring or a tone skip does not occur when monochrome display is performed by setting the R, G, and B input tones to the same value. Also, the given value $\beta_1$ can be set to the register 70 by inputting a command to the interface unit 10, as described above. Note that the given values $\beta_1$ are envisioned to be individual values ($\beta_{1R}$, $\beta_{1G}$, $\beta_{1B}$) for R, G, and B colors, but the given values $\beta_1$ are not limited thereto, and may be a common value for two pieces of color component display data.

Accordingly, tone voltages conforming to the R, G, and B gamma characteristics and the specific gamma characteristic of the display panel can be selected, and furthermore, suppression of degradation of at least one of tone properties and color reproducibility at a specific tone or the like is made possible. For example, the occurrence of failure in display when the white balance is adjusted or the like can be suppressed.

Also, coloring and a tone skip when the white balance is adjusted is not apparent to the human eye in a tone range on a high tone side close to the 255-th tone and in a tone range on a low tone side close to the 0-th tone, and therefore they are not an issue in many cases. On the other hand, the coloring and the tone skip is apparent in a range between the tone range on the high tone side and the tone range on the low tone side.

Therefore, the tone correction range in the present embodiment that is set to at least one color component display data (input tone) from the first color component display data, the second color component display data, and the third color component display data that are input to the data processing unit 20 is desirably a range between the tone range on the high tone side and the tone range on the low tone side. For example, in the aforementioned example in FIG. 9, the tone correction range is a tone range indicated by GCR.

Accordingly, a range in which degradation of at least one of tone properties and color reproducibility is apparent to the human eye can be set as the tone correction range. Therefore, in the range in which degradation of at least one of tone properties and color reproducibility is apparent to the human eye, suppression of degradation of at least one of tone properties and color reproducibility or the like is made possible.

Also, the tone correction range includes a non-boundary range and a boundary range between the outside of the tone correction range and the non-boundary range. For example, as shown in aforementioned FIG. 9, the tone correction range includes at least one of boundary ranges of a first boundary range BR1 at which the range changes from the outside of the tone correction range to the inside of the tone correction range as the tone increases, and a second boundary range BR2 at which the range changes from the inside of the tone correction range to the outside of the tone correction range as the tone increases, and a non-boundary range MR other than at least one of the boundary ranges.

Because the tone correction processing is performed, the tone voltage largely changes relative to the input tone in the boundary ranges (BR1, BR2) of the tone correction range GCR. Therefore, the tone properties may be impaired in the boundary ranges of the tone correction range.

Therefore, in the present embodiment, the correction amount of the input tone is gradually increased or decreased in the boundary ranges (BR1, BR2) of the tone correction range GCR, as shown in FIG. 9. That is, the data processing unit 20 performs, on the color component display data subjected to the multiplication processing, correction processing using a given value $\beta_1$ in the non-boundary range MR, and correction processing using a value $\beta_2$ that is smaller than the given value $\beta_1$ in the boundary ranges (BR1 and BR2).

Here, an example is shown in FIG. 11 in which the correction processing is performed on the input tone in the tone correction range GCR using a given coefficient $\alpha$ and given values $\beta_1$ and $\beta_2$, and thus the corrected tone is calculated. In the example in FIG. 11, the tone correction range GCR is set in the range of tones 53 to 74, and an input tone 53 is set to the first boundary range BR1, and an input tone 74 is set to the second boundary range BR2. In an example of $\alpha$=1.0 and $\beta_1$=0 and an example of $\alpha$=0.94 and $\beta_1$=0, $\beta_2$=0 is set, and tone correction processing (correction processing in a narrow sense, addition or subtraction of $\beta_1$ or $\beta_2$) is not performed in the tone correction range. On the other hand, in an example of $\alpha$=0.94 and $\beta_1$=1, $\beta_2$=0.5 is set, the corrected tone corresponding to an input tone 53 in the first boundary range BR1 is 49.5, and the corrected tone corresponding to an input tone 74 in the second boundary range BR2 is 69.5. Similarly, in an example of $\alpha$=0.94 and $\beta_1$=−1, $\beta_2$=−0.5 is set, the corrected tone corresponding to an input tone 53 in the first boundary range BR1 is 48.5, and the corrected tone corresponding to an input tone 74 in the second boundary range BR2 is 68.5.

Accordingly, a large change in the tone voltage in the boundary range of the tone correction range is suppressed, and suppression of degradation of tone properties in the boundary range or the like is made possible. In other words, the change in the tone characteristics in the boundary range is made smooth, and suppression of degradation of tone properties in the boundary range or the like is made possible.

Note that, although the example in FIG. 11 is an example in which the boundary ranges each include one input tone, the present embodiment is not limited thereto. For example, in the case where the boundary range BR1 includes three input tones and $\beta_1$=2.0, it is possible to make the given value $\beta_2$ larger as it approaches to the non-boundary range MR. For example, it is assumed that the boundary range BR1 includes a first input tone to a third input tone (53 to 55, for example), the first input tone 53 is the tone closest to the outside of the tone correction range, and the third input tone 55 is the tone closest to the non-boundary range MR of the tone correction range. The second input tone 54 is the tone between the first input tone 53 and the third input tone 55. Here, it is possible that $\beta_2$=0.5 is used for the first input tone 53 in the boundary range BR1, $\beta_2$=1.0 is used for the second input tone 54, and $\beta_2$=1.5 is used for the third input tone 55. Accordingly, the change in the tone characteristics can be made smoother in the boundary range.

Also, in the example in FIG. 11, when $\alpha$=0.94 and $\beta_1$=0, and the input tone is 50 or 67, when $\alpha$=0.94 and $\beta_1$=1, and the input tone is 50, 53, 67, or 74, or when $\alpha$=0.94 and $\beta_1$−1, and the input tone is 50, 53, 67, or 74, the corrected tone includes a decimal, and therefore, in this case, a desired tone is realized in a pseudo manner by performing frame rate control tone control (FRC). That is, the data processing unit 20 performs the FRC with respect to the corrected tone when the corrected tone obtained by the correction processing satisfies a given condition.

Accordingly, realization of display of an input tone indicated by at least one of the first color component display data, the second color component display data, and the third color component display data in a pseudo manner or the like is made possible.

Also, by performing the FRC with respect to a tone in the tone correction range, an effect similar to performing the correction processing on the input tone using the aforementioned given values $\beta_1$ and $\beta_2$ can be achieved. That is, in the case where tone voltages generated by the tone voltage generation circuit are used in common for a plurality of pieces of color component display data, and tone voltages for at least two pieces of color component display data are supplied to the display panel at the same time, degradation of at least one of tone properties and color reproducibility at a specific tone can be suppressed.

Specifically, the data processing unit 20 performs multiplication processing in which at least one color component display data is multiplied by the given coefficient $\alpha$ as the correction processing. Then, the data processing unit 20 performs the FRC with respect to the corrected tone when the corrected tone obtained as the result of the multiplication processing satisfies a given condition. Note that the target with respect to which the FRC is performed is not limited to a tone in the tone correction range.

Therefore, in the case where the corrected tone obtained by multiplying the input tone by the given coefficient $\alpha$ satisfies the given condition, pseudo-realization of display of the corrected tone or the like is made possible by performing the FRC. As a result, brightness or a color tone indicated by the original input tone is reproduced with higher fidelity, and suppression of the occurrence of coloring or tone skip when the white balance is adjusted or the like, for example, is made possible.

Furthermore, specifically, when a given condition is satisfied, the data processing unit 20 performs the FRC in which any of a tone that is obtained by adding or subtracting a given difference value to or from the corrected tone and the corrected tone is selected every one or plurality of frames.

The given difference value is 1, for example, but the present embodiment is not limited thereto.

For example, an example in the case where $\alpha=0.94$ and $\beta_1=0$, the input tone is 67, and the corrected tone is 62 (rounding down to an integer) shown in FIG. 11 will be described. In this case, the corrected tone with respect to the input tone 66 is also 62 (rounding down to an integer), and the corrected tone with respect to the input tone 68 is 63 (rounding down to an integer). Therefore, in order to perform a smooth tone change, the corrected tone is desirably 62.5, which is between 62 and 63. However, the tone voltage corresponding to the tone 62.5 is not supplied from the tone voltage generation circuit 35.

Therefore, in the present embodiment, tone display of the input tone 67 (corrected tone 62.5) is realized in a pseudo manner by performing the FRC such as that shown in a selection pattern 1 in FIG. 12, for example. First, a tone 63 to which the given difference value 1 is added to the corrected tone 62 is obtained. Then, the FRC is performed in which the tones 62 and 63 are selected alternately every frame. In this case, a tone voltage $V_{62}$ corresponding to the tone 62 is supplied in a frame 0 to a pixel (subpixel) in the display panel, a tone voltage $V_{63}$ corresponding to the tone 63 is supplied in the next frame 1 to the same pixel, and furthermore the tone voltage $V_{62}$ is again supplied in the next frame 2. By repeating this, tone display of an input tone 67 (corrected tone 62.5) can be realized in a pseudo manner.

Also, performing the FRC with a selection pattern such as the selection pattern 2 in FIG. 12, which is different from the present example, is also possible. In the selection pattern 2, the tone voltage $V_{62}$ corresponding to the tone 62 is selected in two consecutive frames, and thereafter the tone voltage $V_{63}$ corresponding to the tone 63 is selected in one frame thereafter. Then, this operation is repeated. Note that, in the present embodiment, a selection pattern other than the selection pattern 1 and the selection pattern 2 can be arbitrarily set.

Accordingly, expression of a tone corresponding to a tone voltage that is not supplied from the tone voltage generation circuit 35 in a pseudo manner or the like is made possible. For example, in the case where the corrected tone includes a decimal or the like, realization of display of the input tone corresponding to the corrected tone in a pseudo manner or the like is made possible.

As described above, the data processing unit 20 performs correction processing on an i-th tone (i-th input tone) in at least one color component display data so as to obtain an i-th corrected tone. Note that i is an integer that satisfies $0 \le i \le 255$. In the aforementioned example of the selection pattern 1 in FIG. 12, the i-th tone is 67 and the i-th corrected tone is 62. Similarly, the data processing unit 20 performs correction processing on a j-th tone (j-th input tone) in the color component display data so as to obtain a j-th corrected tone. Note that j is an integer that satisfies $j=i\pm1$. In the aforementioned example of the selection pattern 1 in FIG. 12, the j-th tone is 66 and the j-th corrected tone is also 62. Then, the data processing unit 20 performs the FRC in the case where the i-th corrected tone and the j-th corrected tone are determined as being the same tone. That is, the given condition for performing the aforementioned FRC is that the i-th corrected tone and the j-th corrected tone are determined as being the same tone. In the aforementioned example of the selection pattern 1 in FIG. 12, the i-th corrected tone and the j-th corrected tone are both 62, and as a result, the FRC is determined to be performed. Note that even if the i-th corrected tone and the j-th corrected tone are not strictly the same, it is sufficient that the i-th corrected tone and the j-th corrected tone are determined as being the same tone.

The method of obtaining the corrected tone will be described more specifically. The data processing unit 20 performs multiplication processing on the i-th tone in which the i-th tone is multiplied by the given coefficient $\alpha$, and obtains the i-th corrected tone by performing rounding processing on the i-th result of the multiplication processing. Similarly, the data processing unit 20 performs multiplication processing on the j-th tone, and obtains the j-th corrected tone by performing rounding processing on the j-th result of the multiplication processing. Then, the data processing unit 20, in the case where the i-th corrected tone and the j-th corrected tone are determined as being the same tone, performs the FRC in which any of the i-th corrected tone and the i-th corrected tone subjected to addition or subtraction of a given difference value is selected every one or plurality of frames.

Here, the rounding processing is any one of processing of rounding down to an integer, processing of rounding up to an integer, or processing of rounding off to an integer, for example.

Accordingly, in the case where the i-th corrected tone and the j-th corrected tone are the same tone, performing display such that the original i-th input tone and the original j-th input tone are seen as different tones or the like is made possible.

Also, as described above, in the case of $\beta_2=0.5$ or the like, for example, the corrected tone includes decimal numbers in the boundary range.

Thus, the data processing unit 20 also performs the FRC with respect to the corrected tone corresponding to the boundary range. That is, the aforementioned given condition is that the tone indicated by the color component display data is included in the boundary range.

As a result, performing fine tone control or the like is made possible by performing the FRC in the boundary range of the tone correction range.

Figure 13:
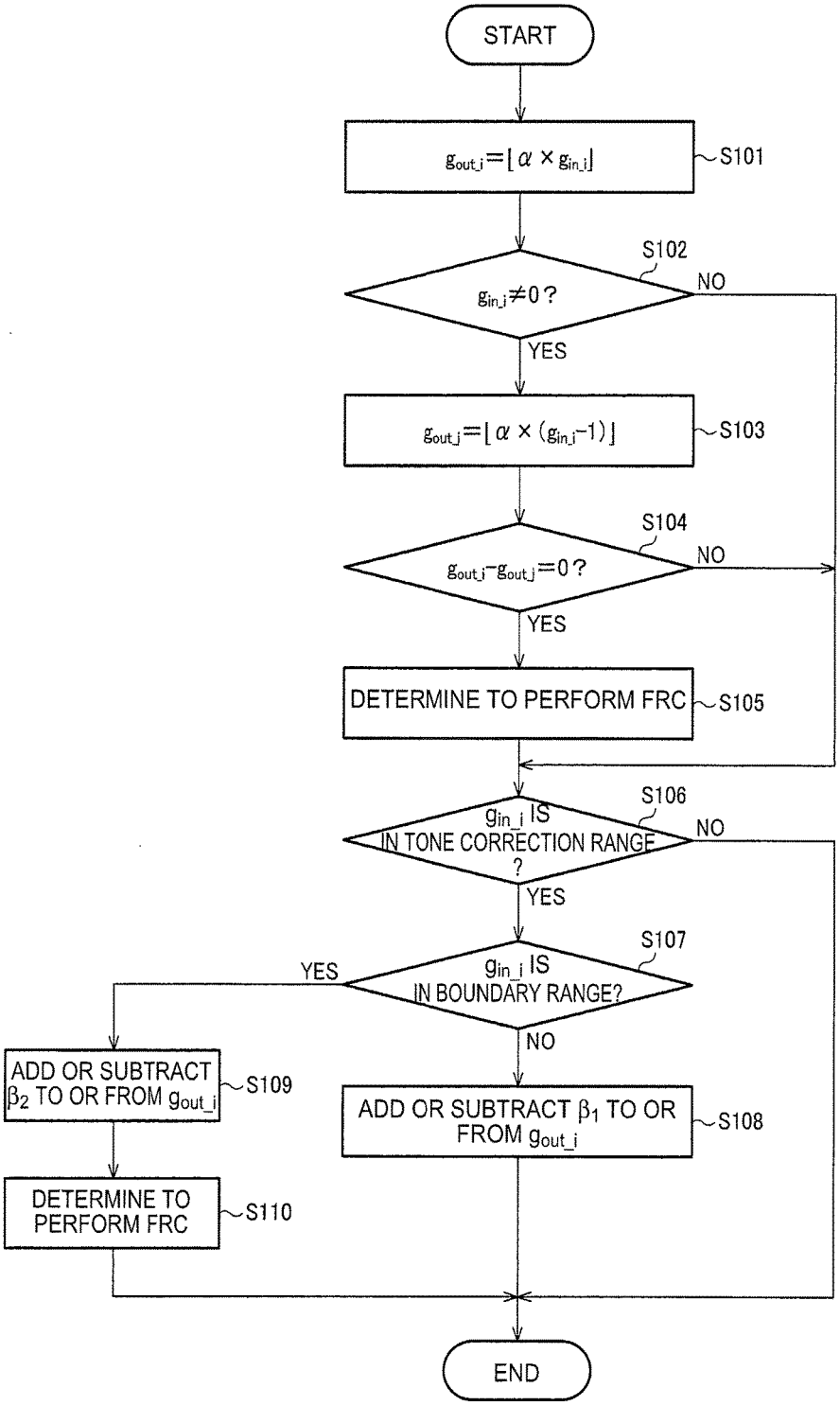
FIG. 13 is a flowchart for describing a flow of the correction processing of tones and determination processing as to whether or not FRC is to be executed.

Next, the tone correction processing of the present embodiment and the determination processing in which the FRC is executed or not is determined will be described using a flowchart in FIG. 13.

First, the data processing unit 20 multiplies an input tone $g_{in_i}$ by a given coefficient $\alpha$, and calculates a corrected tone $g_{out_i}$ by performing processing of rounding down to an integer on the multiplication result (S101). Next, the data processing unit 20 determines whether or not the input tone $g_{in_i}$ is 0 (S102).

In the case where the input tone $g_{in_i}$ is determined as not being 0, the data processing unit 20 multiplies a tone ($g_{in_i}-1$), which is prior to the input tone $g_{in_i}$ by one, by the given coefficient $\alpha$, and calculates a corrected tone $g_{out_i}$ by performing processing of rounding down to an integer on the multiplication result (S103).

Then, the data processing unit 20 determines whether or not the difference between the corrected tone $g_{out_i}$ and the corrected tone $g_{out_i}$ is 0 (S104). In the case where the difference between the corrected tone $g_{out_i}$ and the corrected tone $g_{out_i}$ is determined as being 0, that is, the corrected tone $g_{out_i}$ and the corrected tone $g_{out_i}$ are determined as being the same tone, the data processing unit 20 determines to perform the FRC with respect to the corrected tone $g_{out_i}$ (S105), and advances the processing to step S106.

On the other hand, in the case where the difference between the corrected tone $g_{out_i}$ and the corrected tone $g_{out_j}$ is determined as not being 0, that is, the corrected tone $g_{out_i}$ and the corrected tone $g_{out_j}$ are determined as not being the same tone, the data processing unit 20 advances the processing to step S106 without performing the processing in step S105. Also, in the case where the input tone $g_{in_i}$ is determined as being 0 in step S102, the data processing unit 20 advances the processing to step S106 without performing processing in steps S103 to S105.

Next, the data processing unit 20 determines whether or not the input tone $g_{in_i}$ is in the tone correction range (S106).

Then, the data processing unit 20, upon determining that the input tone $g_{in_i}$ is in the tone correction range, determines whether or not the input tone $g_{in_i}$ is in the boundary range of the tone correction range (S107).

The data processing unit 20, upon determining that the input tone $g_{in_i}$ is not in the boundary range of the tone correction range, adds or subtracts a given value $\beta_1$ to or from the corrected tone $g_{out_i}$ (S108), and ends the processing.

On the other hand, the data processing unit 20, upon determining that the input tone $g_{in_i}$ is in the boundary range of the tone correction range, adds or subtracts a given value $\beta_2$ ($\beta_2<\beta_1$) to or from the corrected tone $g_{out_i}$ (S109), determines that the FRC is to be performed with respect to the corrected tone $g_{out}$ (S110), and ends the processing. Note that various settings (such as a setting of the given coefficient $\alpha$ and a setting of the tone correction range and the boundary range) with which the FRC is determined to be performed in step S105, and an input tone $g_{in_i}$ is determined to be in the boundary range of the tone correction range are prohibited in advance.

Also, the data processing unit 20, upon determining that the input tone $g_{in_i}$ is not in the tone correction range in step S106, ends the processing.

5. Dual Gate

Figure 14:
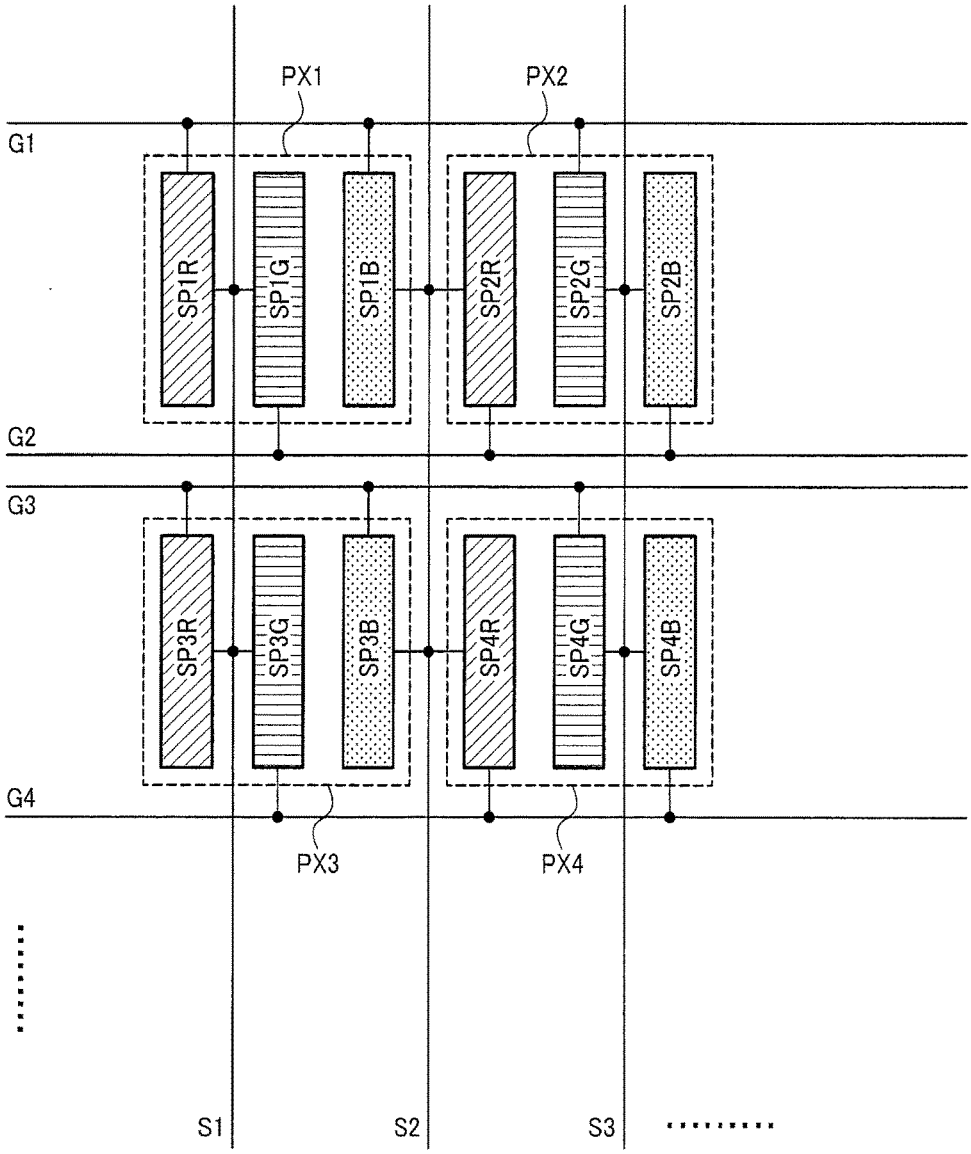
FIG. 14 is a diagram for describing a specific exemplary configuration of a display panel.

Next, a display panel used in the present embodiment is illustrated in FIG. 14. Hereinafter, although description will be given taking a display panel with a dual gate structure among active matrix type display panels (a TFT liquid crystal panel, for example) as an example, the invention can be applied to display panels other than the display panel with a dual gate structure (a single gate structure or a triple gate structure, for example). Also, the invention can be applied to a self-luminous panel (an organic EL panel, for example) or the like, without being limited to the liquid crystal panel.

The display panel used in the present embodiment is a panel that is provided with a first scan line (first gate line) G1 and a second scan line (second gate line) G2 that are provided so as to be associated with a display line, and that includes a first pixel group (SP1R, SP1B, SP2G) that is selected by the first scan line G1, and a second pixel group (SP1G, SP2R, SP2B) that is selected by the second scan line G2, as shown in FIG. 14, and in which data lines of a plurality of data lines (S1, S2, S3, etc.) are respectively shared by respective pixels in the first pixel group and respective pixels in the second pixel group.

FIG. 14 is an exemplary configuration of a color display panel to be driven by the circuit device 100, and a portion of a pixel array is shown. Pixels PX1 and PX2 are pixels on a first horizontal display line, and pixels PX3 and PX4 are pixels on a second horizontal display line. Each pixel includes R, G, and B subpixels. For example, the pixel PX1 is constituted by a subpixel SP1R provided with a color filter of a first color (R), a subpixel SP1G provided with a color filter of a second color (G), and a subpixel SP1B provided with a color filter of a third color (B).

Each data line is connected to two subpixels in common in each horizontal display line. For example, on the first horizontal display line, the data line S1 is connected to the subpixels SP1R and SP1G, and the data line S2 is connected to the subpixels SP1B and SP2R. Two gate lines are provided for each horizontal display line. One of the two gate lines is connected to one of the two subpixels connected to one data line, and the other of the two gate lines is connected to the other of the two subpixels connected to the one data line. For example, the first horizontal display line is provided with the gate lines G1 and G2, the gate line G1 is connected to the subpixel SP1R of the subpixels SP1R and SP1G connected to the data line S1, and the gate line G2 is connected to the subpixel SP1G.

For example, in a horizontal scanning period in which the first horizontal display line is driven, the circuit device 100 selects the gate lines G1 and G2 in a time division manner in the horizontal scanning period. In a period in which the gate line G1 is selected, writing into the subpixels SP1R, SP1B, and SP2G is performed by outputting tone voltages of the subpixels SP1R, SP1B, and SP2G respectively to the data lines S1, S2, and S3. In a period in which the gate line G2 is selected, writing into the subpixels SP1G, SP2R, and SP2B is performed by outputting tone voltages of the subpixels SP1G, SP2R, and SP2B respectively to the data lines S1, S2, and S3.

That is, in the circuit device 100, the interface unit 10 accepts pieces of display data RD, GD, and BD for R, G, and B colors, the data processing unit 20 outputs pieces of display data RQ1, GQ1, and BQ1 for R, G, and B colors, and the drive unit 60 respectively writes tone voltages corresponding to the pieces of display data RQ1, GQ1, and BQ1 to the subpixels SP1R, SP1G, and SP1B of the pixel PX1. In this way, R, G, and B tone voltages are written into each pixel, and a color image is displayed on the display panel.

Note that pieces of the display data RQ1, GQ1, and BQ1 are pieces of output data of the data processing unit 20, and are pieces of display data each corresponding to a pixel or a subpixel of the display panel. For example, in the case of the color display panel in FIG. 14, the pieces of the display data RQ1, GQ1, and BQ1 respectively correspond to the subpixel SP1R of a first color (red), the subpixel SP1G of a second color (green), and the subpixel SP1B of a third color (blue) of the pixel PX1.

By using such a display panel, reduction of the number of data lines in the display panel or the like is made possible. Note that the configuration of the pixel array in the display panel with a dual gate structure is not limited to the configuration in FIG. 14. For example, in the subpixels SP1R, SP1G, SP1B, and SP2R, the subpixels SP1R and SP2R may be connected to the gate line G1 (first pixel group), and the subpixels SP1G and SP1B may be connected to the gate line G2 (second pixel group). Alternatively, in the subpixels SP1R, SP1G, SP3R, and SP3G, the subpixels SP1R and SP3G may be respectively connected to the gate lines G1 and G3, and the subpixels SP1G and SP3R may be respectively connected to the gate lines G2 and G4. Various modifications other than these are possible.

6. Electro-Optical Device and Electronic Apparatus

Figure 15:
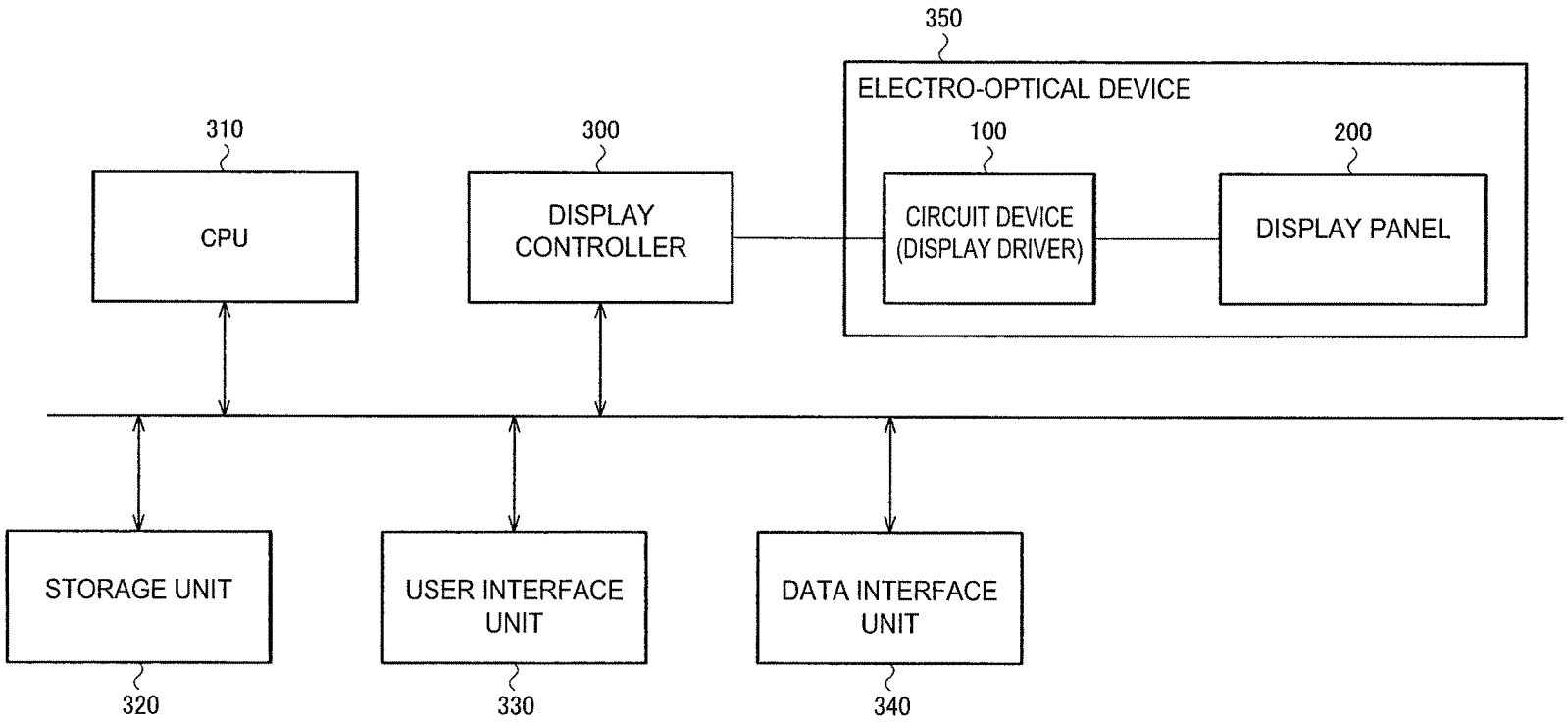
FIG. 15 is a diagram for describing an exemplary configuration of an electronic apparatus and an electro-optical device.

An exemplary configuration of an electro-optical device and an electronic apparatus to which the circuit device 100 of the present embodiment can be applied is shown in FIG. 15. Various electronic apparatuses, on which a display device is mounted, such as an on-board display device (such as a meter panel, for example), a monitor, a display, a single-panel projector, a television device, an information processing device (computer), a mobile information terminal, a car navigation system, a mobile game terminal, a DLP (Digital Light Processing) device, and a printer, for example, can be envisioned as an electronic apparatus of the present embodiment.

An electronic apparatus shown in FIG. 15 includes an electro-optical device 350, a CPU 310 (a processing device, in a broad sense), a display controller 300 (host controller), a storage unit 320, a user interface unit 330, and a data interface unit 340. The electro-optical device 350 includes a circuit device 100 (display driver) and a display panel 200.

The display panel 200 is a matrix type liquid crystal display panel, for example. Alternatively, the display panel 200 may be an EL (Electro-Luminescence) display panel using a self-luminous element. For example, the display panel 200 is formed on a glass substrate, and the circuit device 100 is mounted on the glass substrate. The electro-optical device 350 is configured as a module including the display panel 200 and the circuit device 100 (the electro-optical device 350 may further include the display controller 300). Note that the display controller 300 and the circuit device 100 may be incorporated in the electronic apparatus as separate components instead of being configured as a module.

The user interface unit 330 is an interface unit for accepting various operations from a user. The user interface unit 330 is constituted by a button, a mouse, a keyboard, a touch panel installed in the display panel 200, or the like, for example. The data interface unit 340 is an interface unit that performs inputting and outputting of image data and control data. The data interface unit 340 is a wired communication interface such as a USB, or a wireless communication interface such as a wireless LAN, for example. The storage unit 320 stores image data that is input from the data interface unit 340. Alternatively, the storage unit 320 functions as a work memory for the CPU 310 and the display controller 300. The CPU 310 performs control processing on the units of the electronic apparatus and various data processing. The display controller 300 performs control processing on the circuit device 100. For example, the display controller 300 converts the image data transmitted from the data interface unit 340 or the storage unit 320 via the CPU 310 to a format acceptable to the circuit device 100, and outputs the converted image data to the circuit device 100. The circuit device 100 drives the display panel 200 based on the image data transmitted from the display controller 300.

Note that, although the present embodiment has been described above in detail, those skilled in the art will easily understand that various modifications are possible without substantially departing from the new matter and the effect of the invention. Accordingly, all those modifications are to be encompassed in the scope of the invention. For example, a term that is used at least once together with another term having a broader or the same meaning in the specification or the drawings may be replaced with another term in any part of the specification or the drawings. Configurations, operations, or the like of the circuit device, the electro-optical device, and the electronic apparatus are not limited to those described in the present embodiment either, and may be modified in various manners.

This application claims priority from Japanese Patent Application No. 2015-189107 filed in the Japanese Patent Office on Sep. 28, 2015 the entire disclosure of which is hereby incorporated by reference in its entirely.

What is claimed is:

1. A circuit device comprising:

a grayscale voltage generation circuit configured to generate a plurality of grayscale voltages;

a data processing circuit configured to perform data processing of first color component display data, second color component display data, and third color component display data; and a drive circuit configured to drive a display panel based on the first color component display data, the second color component display data, and the third color component display data that have been subjected to the data processing and are obtained from the data processing circuit, and the plurality of grayscale voltages that are obtained from the grayscale voltage generation circuit and are used in common for the first color component display data, the second color component display data, and the third color component display data, wherein the data processing circuit is configured to perform, in a set grayscale correction range, correction processing for grayscale on at least one color component display data of the first color component display data, the second color component display data, and the third color component display data.

2. The circuit device according to claim 1, further comprising a register for setting the grayscale correction range.

3. The circuit device according to claim 1, wherein the data processing circuit is configured to perform multiplication processing in which the at least one color component display data is multiplied by a given coefficient $\alpha$, and perform, in the grayscale correction range, the correction processing in which a given value $\beta_1$ is added to or subtracted from the color component display data subjected to the multiplication processing.

4. The circuit device according to claim 3, further comprising a register for setting the given coefficient $\alpha$ and the given value $\beta_1$.

5. The circuit device according to claim 3, wherein the grayscale correction range includes:

a non-boundary range; and a boundary range between an outside of a grayscale correction range and the non-boundary range, and the data processing circuit is configured to perform, in the non-boundary range, the correction processing on the color component display data subjected to the multiplication processing using the given value $\beta_1$, and perform, in the boundary range, the correction processing using a value $\beta_2$ that is smaller than the given value $\beta_1$.

6. The circuit device according to claim 1, wherein the grayscale correction range is set with respect to the at least one color component display data of the first color component display data, the second color component display data, and the third color component display data that are to be input to the data processing circuit, and is a range between a grayscale range on a high grayscale side and a grayscale range on a low grayscale side.

7. The circuit device according to claim 1, wherein the data processing circuit is configured to, in a case where a corrected grayscale obtained by the correction processing satisfies a given condition, perform frame rate control grayscale control with respect to the corrected grayscale.

8. The circuit device according to claim 7, wherein the data processing circuit is configured to perform, in a case where the given condition is satisfied, the frame rate control grayscale control in which any of a grayscale resulting from a given difference value being added to or subtracted from the corrected grayscale and the corrected grayscale is selected every one or plurality of frames.

9. The circuit device according to claim 8, wherein the data processing circuit is configured to obtain an i-th corrected grayscale by performing the correction processing on an i-th grayscale (i is an integer that satisfies $0 \leq i \leq 255$) in the at least one color component display data, obtain a j-th corrected grayscale by performing the correction processing on a j-th grayscale a is an integer that satisfies $j=i+1$) that is next to the i-th grayscale in the color component display data, and perform the frame rate control grayscale control in a case where the given condition that the i-th corrected grayscale and the j-th corrected grayscale are determined as being the same grayscale is satisfied.

10. The circuit device according to claim 9, wherein the data processing circuit is configured to perform multiplication processing in which the i-th grayscale is multiplied by a given coefficient $\alpha$, and obtain the i-th corrected grayscale by performing rounding processing on an i-th result of the multiplication processing, perform the multiplication processing on the j-th grayscale, and obtain the j-th corrected grayscale by performing the rounding processing on a j-th result of the multiplication processing, and perform, in a case where the given condition that the i-th corrected grayscale and the j-th corrected grayscale are determined as being the same grayscale is satisfied, the frame rate control grayscale control in which any of the i-th corrected grayscale and a grayscale resulting from a given difference value being added to or subtracted from the i-th corrected grayscale is selected every one or plurality of frames.

11. The circuit device according to claim 7, wherein the grayscale correction range includes:

a non-boundary range; and a boundary range between an outside of a grayscale correction range and the non-boundary range, and the data processing circuit is configured to perform, in a case where the given condition that a grayscale indicated by the color component display data is included in the boundary range is satisfied, the frame rate control grayscale control with respect to the corrected grayscale corresponding to the boundary range.

12. The circuit device according to claim 7, further comprising a register for setting whether the frame rate control grayscale control is enabled or disabled.

13. The circuit device according to claim 1, wherein the display panel is a panel that is provided with a first scan line and a second scan line that are provided so as to be associated with a display line, and that includes a first pixel group that is selected by the first scan line and a second pixel group that is selected by the second scan line, and in which data lines of a plurality of data lines are respectively shared by respective pixels in the first pixel group and respective pixels in the second pixel group.

14. An electro-optical device comprising:

the circuit device according to claim 1; and the display panel.

15. An electronic apparatus comprising the circuit device according to claim 1.

16. A circuit device comprising:

a grayscale voltage generation circuit configured to generate a plurality of grayscale voltages;

a data processing circuit configured to perform data processing of first color component display data, second color component display data, and third color component display data; and a drive circuit configured to drive a display panel based on the first color component display data, the second color component display data, and the third color component display data that are subjected to the data processing and are obtained from the data processing circuit, and the plurality of grayscale voltages that are obtained from the grayscale voltage generation circuit and are used in common for the first color component display data, the second color component display data, and the third color component display data, wherein the data processing circuit is configured to perform correction processing for grayscale on at least one color component display data of the first color component display data, the second color component display data, and the third color component display data, and, in a case where a corrected grayscale obtained by the correction processing satisfies a given condition, perform frame rate control grayscale control with respect to the corrected grayscale.

17. The circuit device according to claim 16, wherein the data processing circuit is configured to perform multiplication processing in which the at least one color component display data is multiplied by a given coefficient $\alpha$ as the correction processing.

* * * * *